US007846071B2

(12) United States Patent
Fenster et al.

(10) Patent No.: US 7,846,071 B2
(45) Date of Patent: Dec. 7, 2010

(54) STATIONARY EXERCISE APPARATUS

(75) Inventors: Mrako A Fenster, Madison, WI (US); Alexander E Hanson, Madison, WI (US); Donald E Stiemke, Madison, WI (US)

(73) Assignee: Johnson Health Tech Co., Ltd. (TW)

( * ) Notice: Subject to any disclaimer, the term of this patent is extended or adjusted under 35 U.S.C. 154(b) by 0 days.

(21) Appl. No.: 12/636,283

(22) Filed: Dec. 11, 2009

(65) Prior Publication Data

US 2010/0093498 A1 Apr. 15, 2010

Related U.S. Application Data

(63) Continuation-in-part of application No. 11/497,784, filed on Aug. 2, 2006, now Pat. No. 7,654,936, which is a continuation-in-part of application No. 11/434,541, filed on May 15, 2006, now Pat. No. 7,682,290.

(51) Int. Cl.
*A63B 22/04* (2006.01)
*A63B 22/02* (2006.01)

(52) U.S. Cl. ..... 482/52; 482/54

(58) Field of Classification Search ..... 482/52, 482/57, 62, 70, 79–80
See application file for complete search history.

(56) References Cited

U.S. PATENT DOCUMENTS

| | | | | |
|---|---|---|---|---|
| 2,117,957 | A * | 5/1938 | Heller | 482/54 |
| 5,897,941 | A * | 4/1999 | Shah | 428/213 |
| 6,849,033 | B1 * | 2/2005 | Stearns et al. | 482/52 |
| 7,618,350 | B2 * | 11/2009 | Dalebout et al. | 482/52 |
| 7,654,936 | B2 * | 2/2010 | Liao et al. | 482/52 |
| 7,674,205 | B2 * | 3/2010 | Dalebout et al. | 482/52 |
| 7,775,940 | B2 * | 8/2010 | Dalebout et al. | 482/52 |
| 2010/0093498 | A1 * | 4/2010 | Fenster et al. | 482/52 |

* cited by examiner

*Primary Examiner*—Steve R Crow
(74) *Attorney, Agent, or Firm*—Robert Burck

(57) ABSTRACT

A stationary exercise device having variable footpaths is disclosed. The exercise device includes a frame, a pair of supporting members that have a first end to rotate about an axis and a second end to move along a reciprocating path, a pair of pedals joined to the supporting members, and a guider assembly for adjusting an incline angle of the reciprocating path.

12 Claims, 25 Drawing Sheets

STATIONARY EXERCISE APPARATUS

CROSS-REFERENCE TO RELATED APPLICATION

This is a continuation-in-part of U.S. patent application Ser. No. 11/497,784, filed on Aug. 2, 2006, now U.S. Pat. No. 7,654,936 which is a continuation-in-part of U.S. patent application Ser. No. 11/434,541, filed on May 15, 2006 now U.S. Pat. No. 7,682,290.

BACKGROUND

1. Field of the Invention

This invention relates to stationary exercise apparatus, and more particularly to stationary exercise apparatus with adjustable components to vary the footpath and enhance exercise intensity of a user.

2. Description of the Related Art

Stationary exercise apparatus have been popular for several decades. Early exercise apparatus typically had a single mode of operation, and exercise intensity was varied by increasing apparatus speed. More recently, enhancing exercise intensity in some apparatus has been made by adjusting the moving path of user's feet, such as by adjusting the incline or stride length of user's foot path.

U.S. Pat. No. 5,685,804 discloses two mechanisms for adjusting the incline of a stationary exercise apparatus, one of them having a linear track which can be adjusted and the other having a length adjusting swing arm. The swing arm lower end can be moved upwardly for a high incline foot path. U.S. Pat. No. 6,168,552 also discloses a stationary exercise apparatus having a linear track for changing the incline of the stationary exercise apparatus. U.S. Pat. No. 6,440,042 discloses a stationary exercise apparatus having a curved track for adjusting the incline of the stationary exercise apparatus.

Nonetheless, there is still a need for an exercise apparatus that can increase varieties of exercise and enhance exercise intensity of a user.

SUMMARY

A stationary exercise apparatus in accordance with present invention includes a frame having a base, first and second supporting members coupled to the frame to rotate about an axis, a guider assembly coupled to the base, and first and second pedals coupled to the first and second supporting members. While operating the stationary exercise apparatus, the first and second pedals move along a closed path that can have a variety of shapes to vary the exercise experience and intensity. The present invention provides: a user of the stationary exercise apparatus with a benefit of high exercise intensity; an inclined foot path; a variable stride length; better gluteus exercise; and a more compact and succinct appearance.

DETAIL DESCRIPTION

Figure 1:
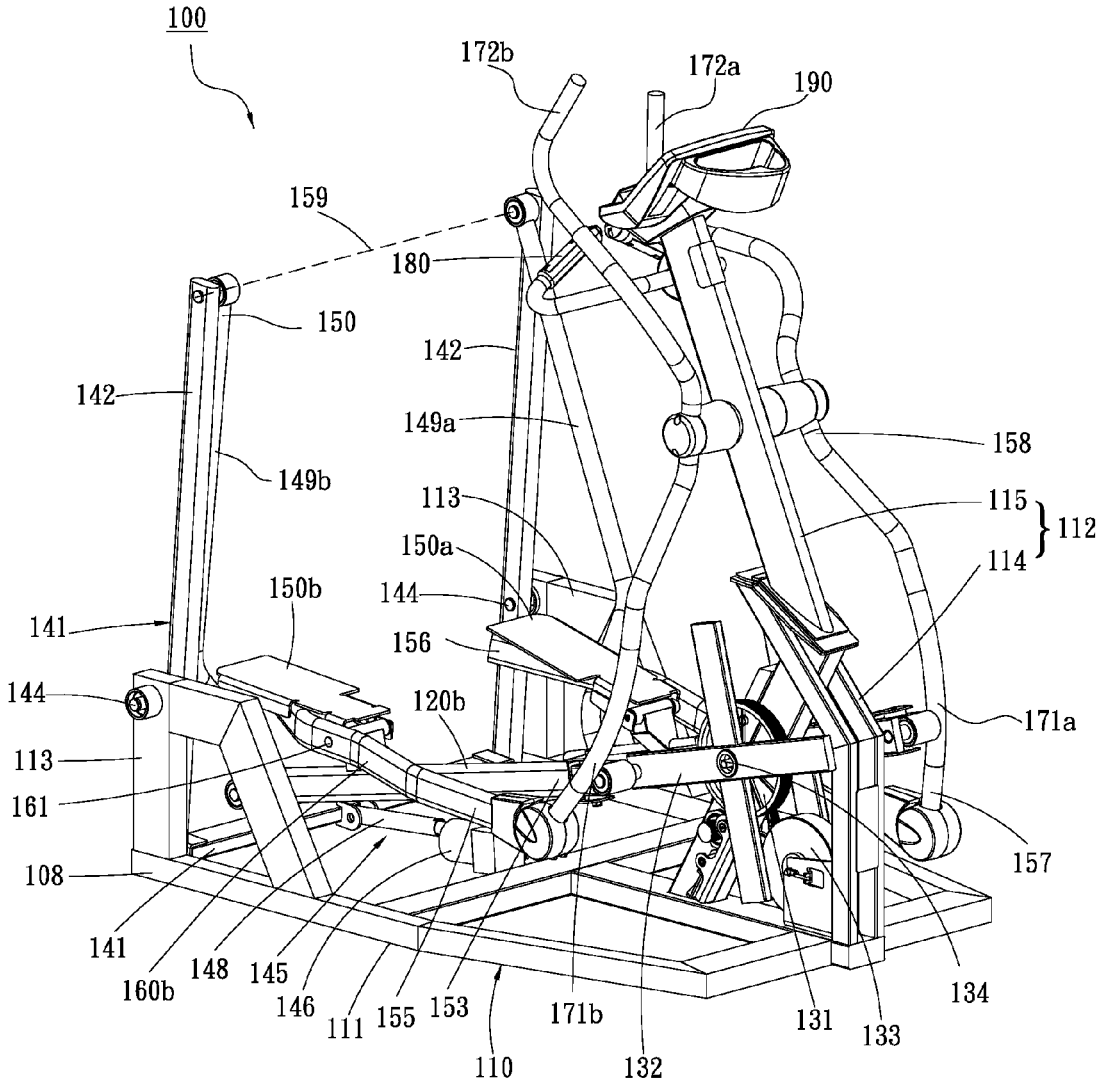
FIG. 1 is a perspective view of a stationary exercise apparatus according to a first embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Now referring to FIG. 1, a stationary exercise apparatus 100 is illustrated therein. The stationary exercise apparatus 100 has a frame 110 generally comprising a base 111, a front portion 112, a rear portion 108, and side portions 113. The base 111 is substantially a horizontal frame adapted to stably rest on a ground, floor or other similar supporting surface. The front portion 112 is fixed on the base 111, and preferably includes a post 114 and a standard 115. The side portions 113 are respectively mounted on the left and right sides of the base portion 111. A fixed handle assembly 180 and a console 190 are mounted on or near the upper end of the standard 115. Left and right cranks 132 are each pivoted to one portion of the frame 110 defining a first axis 134 and in the illustrated embodiment, the first axis 134 is at or near the front portion of the frame 110. The left and right cranks 132 could be replaced by a pair of disks, flywheels, or other devices rotating about the first axis 134. The left and right cranks 132 and the first axis 134 can also be replaced by a pair of closed tracks circulating about a virtual axis, as opposed to an axis defined by a wheel axle. The frame 110 may further comprise a pulley 133 and a resistance member 135 which is controlled by using the console 190 to vary operating resistance for a user.

Figure 2:
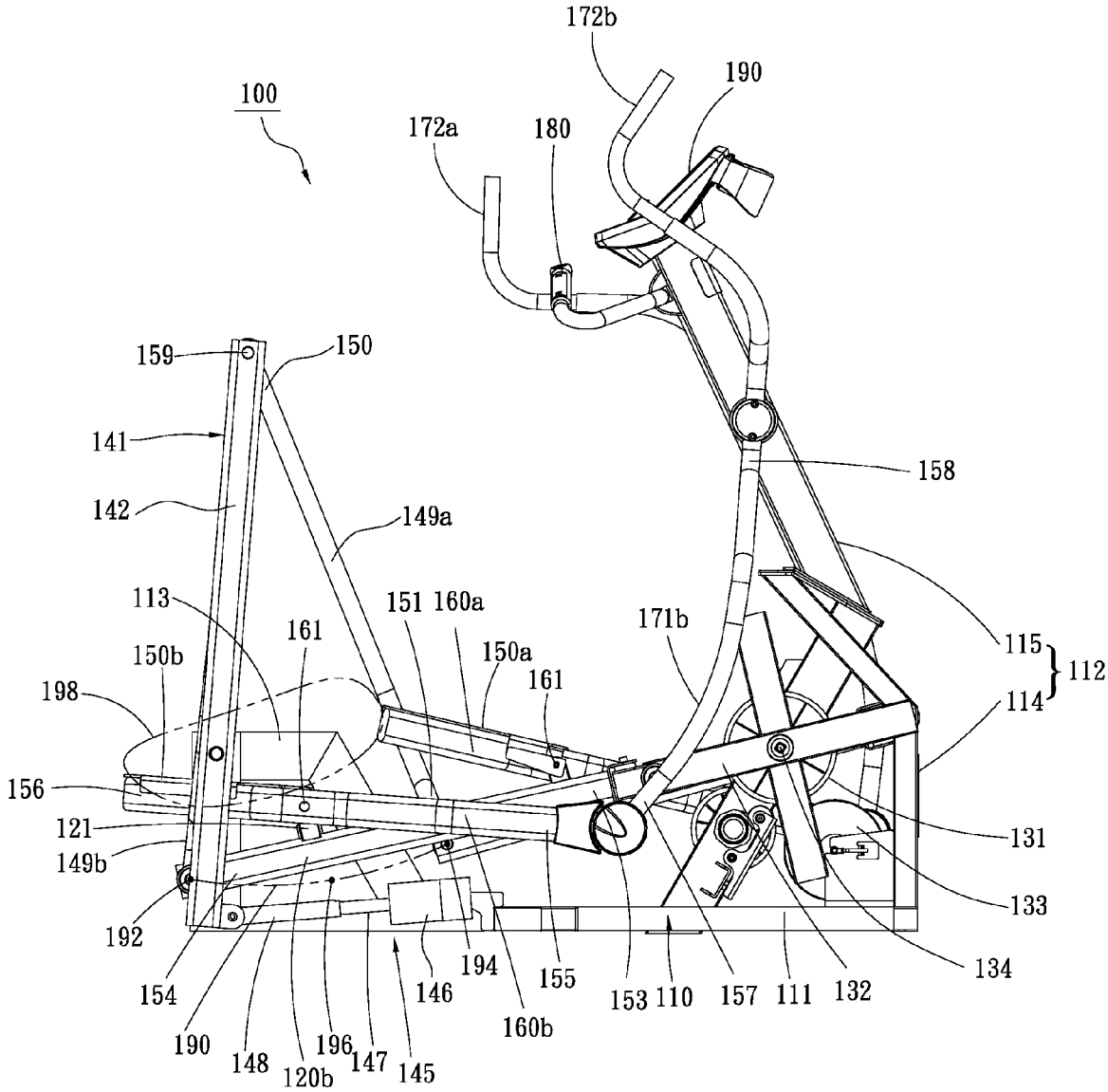
FIG. 2 is a side view of the stationary exercise apparatus of FIG. 1 in a rotating position of a low incline condition.
Figure 3:
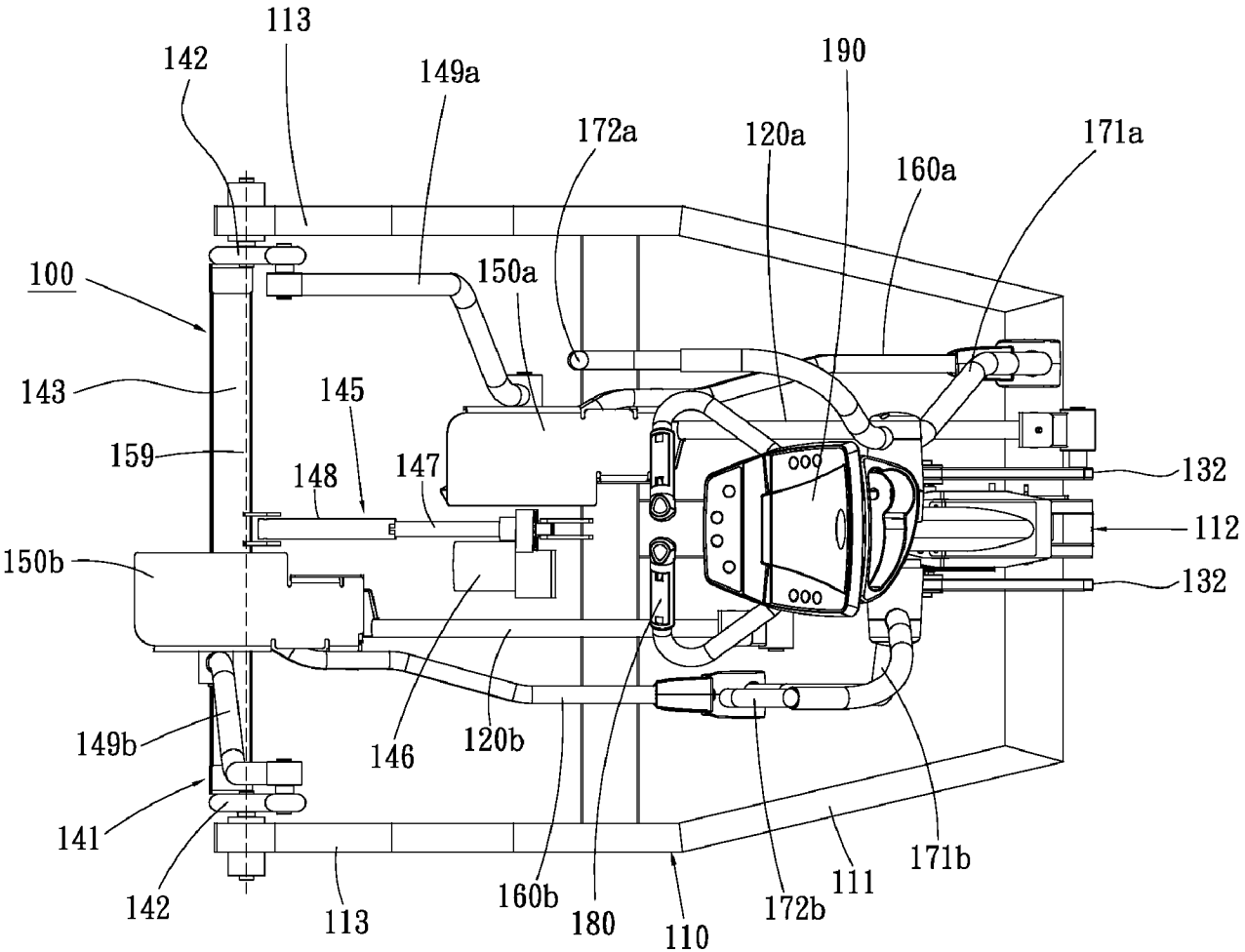
FIG. 3 is a top view of the stationary exercise apparatus of FIG. 1.
Figure 6:
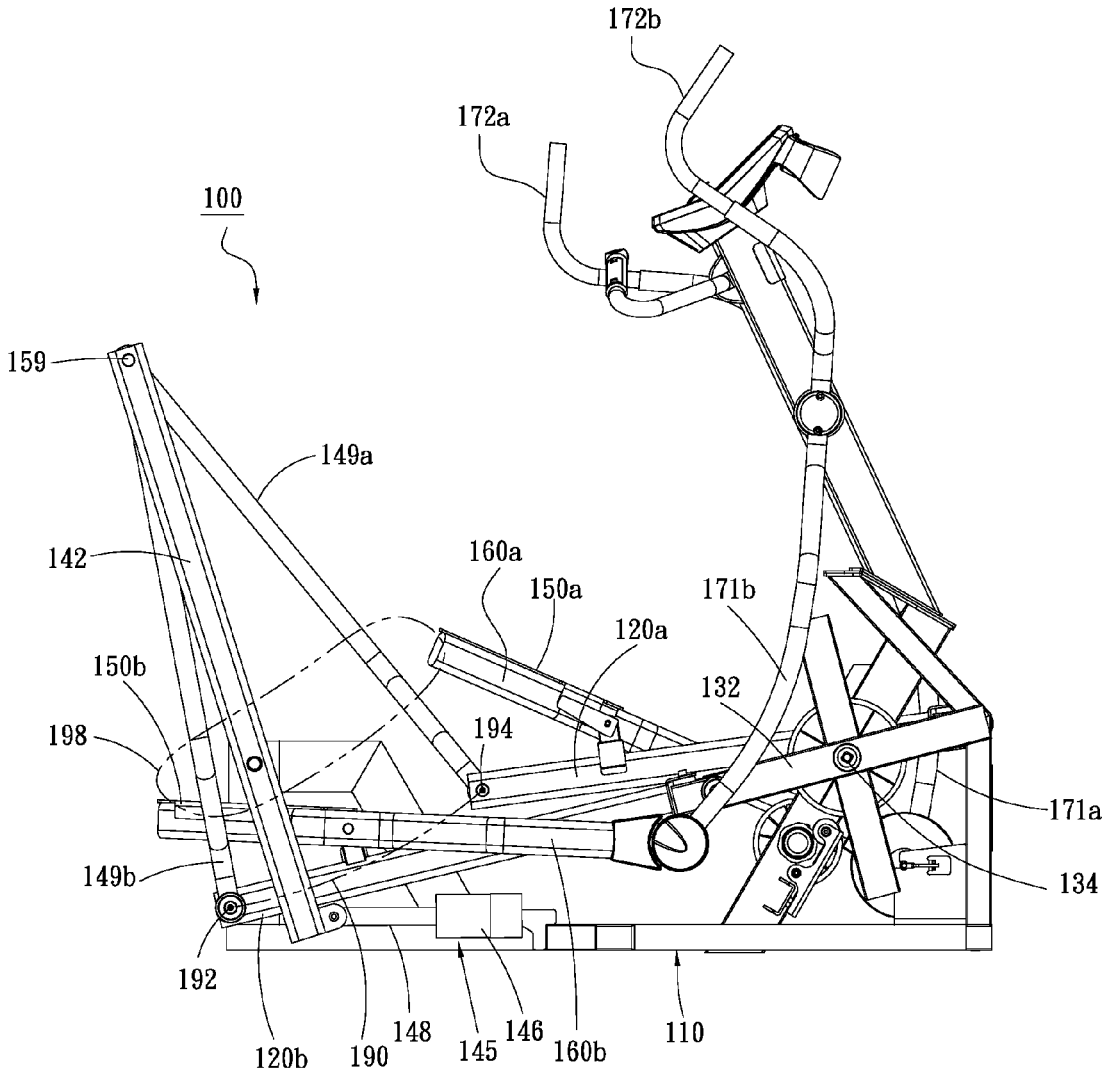
FIG. 6 is a side view of the stationary exercise apparatus of FIG. 1 in a rotating position of a high incline condition.

Now referring to FIGS. 1 and 2, the frame 110 further comprises a moving assembly 141 mounted on the side portions 113 respectively. In a preferred embodiment of the present invention as shown in FIG. 1, the moving assembly 141 has first and second moving members 142, in a generally upright position, and a lateral link 143 (FIG. 4) connecting the first and second moving members 142 to one another. The first and second moving members 142 are joined to the side portions 113 via a second axis 144 so that the upper end portions of the first and second moving members 142 can be adjusted by pivoting the first and second moving members 142 about the second axis 144. There is an optional adjusting assembly 145 mounted between the moving assembly 141 and the frame 110 for adjusting the moving assembly 141 about the second axis 144. The preferred embodiment of the adjusting assembly 145 generally includes a motor 146, a screw rod 147, and a screw tube 148. The motor 146 has one end connected to the base portion 111 and the other end connected to one end of the screw rod 147. The other end of the screw rod 117 is connected to one end of the screw tube 148. The other end of the screw tube 148 is connected to the moving assembly 141 so that the effective length of the screw rod 147 and the screw tube 148 combination is adjustable to move the lower end of the first and second moving members 142 fore and aft. As the lower ends move, the upper ends of the first and second moving members 142 are pivoted in the opposite direction about the second axis 144. The upper end portions of the first and second moving members 142 are adjustable anywhere between a first position as shown in FIG. 2 and a second position as shown in FIG. 6. Although described and illustrated as a screw adjusting mechanism, the adjusting assembly 145 could be any manual or automatic mechanical, electromechanical, hydraulic, or pneumatic device and be within the scope of the invention. The adjusting assembly 145 is illustrated as being mounted on the right side of the exercise device 100, but both moving members 142 are adjusted because a lateral link 143 (FIG. 4) transfers the force to the left side moving member 143.

Figure 4:
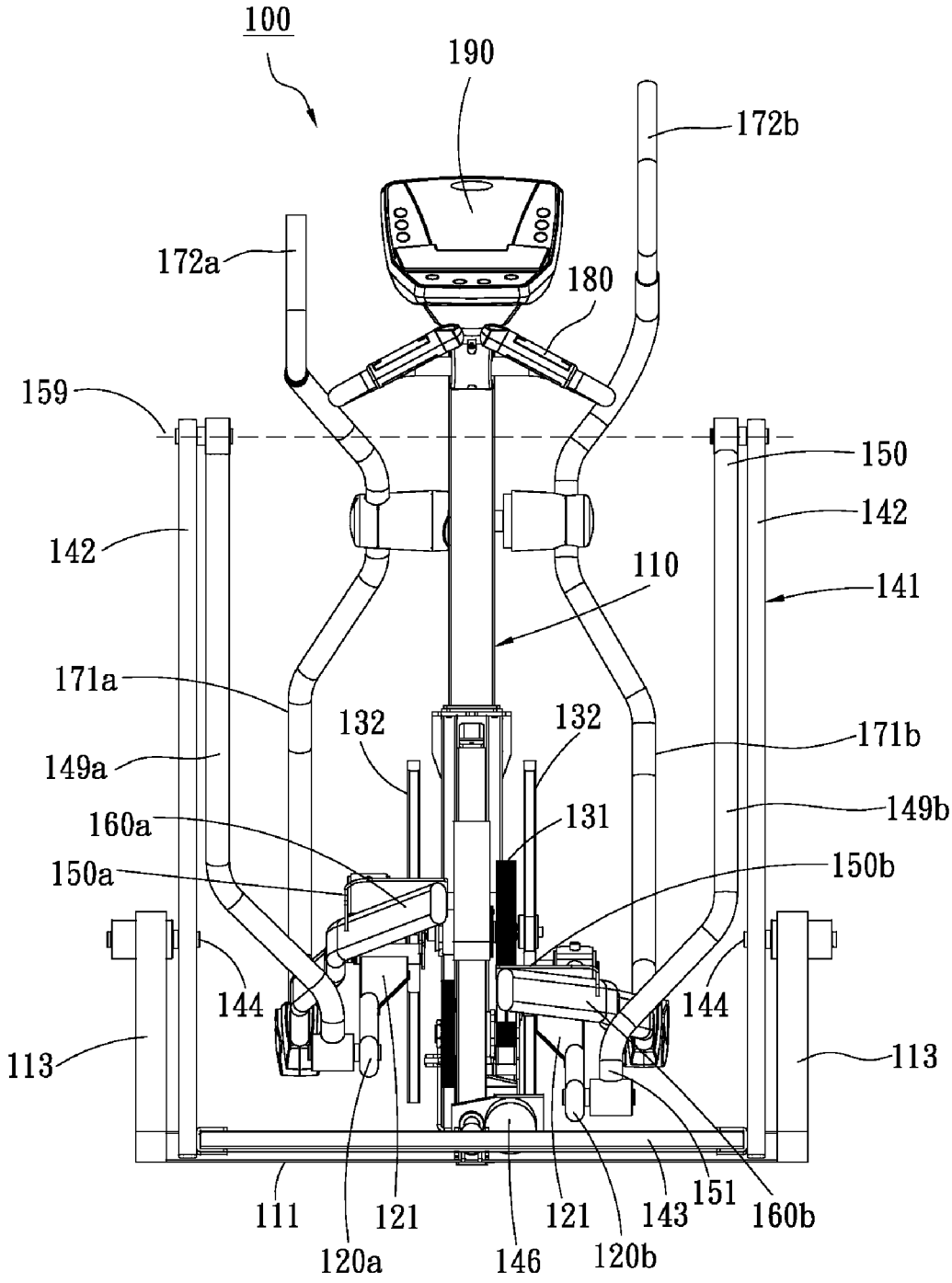
FIG. 4 is a back view of the stationary exercise apparatus of FIG. 1.

Referring to FIGS. 2 and 4, the stationary exercise apparatus 100 comprises first and second swing members 149*a*/149*b*, each of the swing members 149*a*/149*b* having an upper portion 150 and a lower portion 151. The upper portions 150 of the first and second swing members 149*a*/149*b* can be coupled to the frame 110 via a swing axis 159 for swinging motion relative to the frame. In the preferred embodiment of the present invention, the upper portions 150 of the first and second swing members 149*a*/149*b* are respectively pivoted to the first and second moving members 142 via the swing axis 159 so that the swing axis 159 can be adjusted forward or backward anywhere between the first position shown in FIG. 2 and the second position shown in FIG. 6. Different positions of the swing axis 159 cause different exercise intensity of the stationary exercise apparatus 100.

Figure 5:
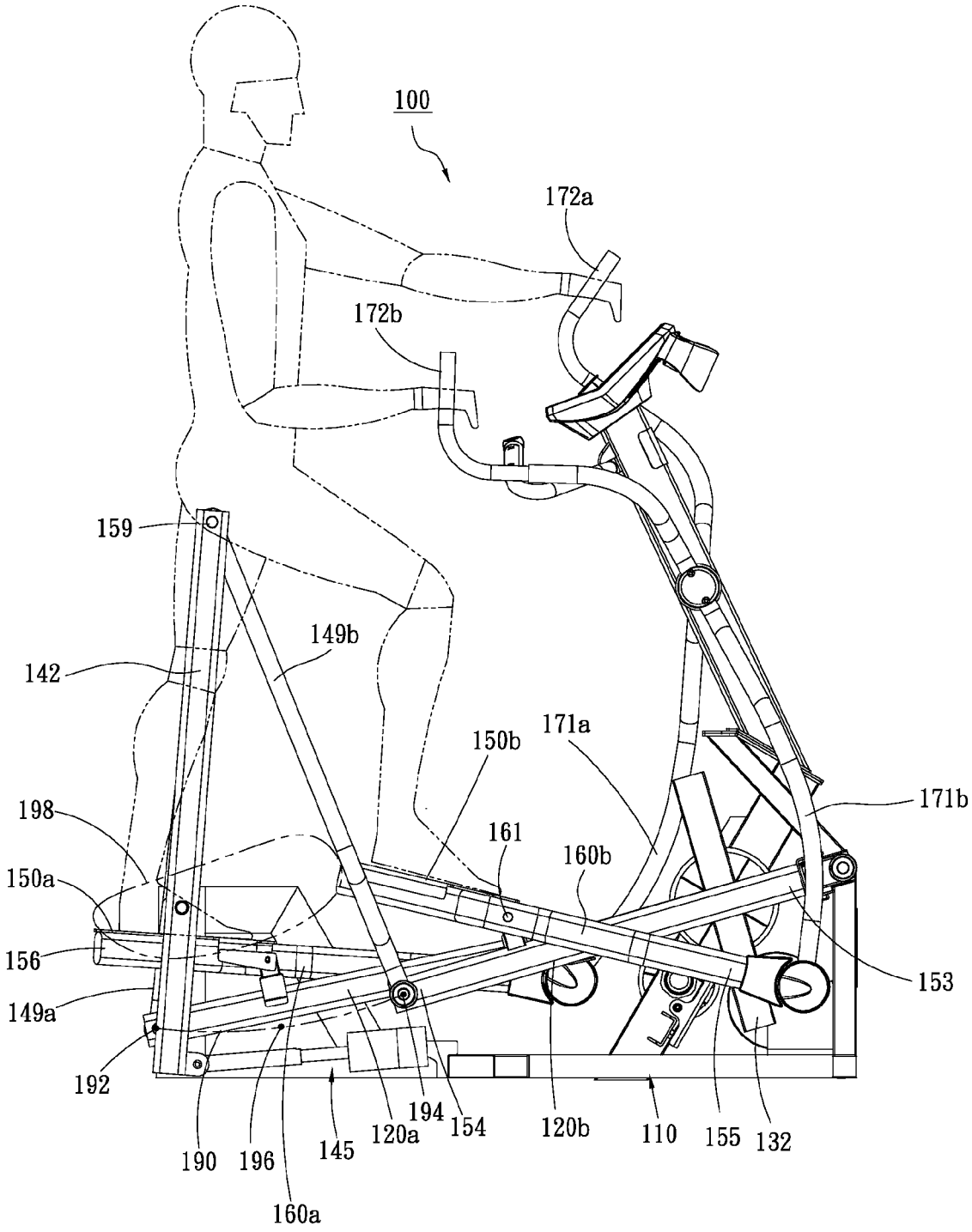
FIG. 5 is a side view of the stationary exercise apparatus of FIG. 1 in another rotating position of the low incline condition.

Now referring to FIGS. 2, 4 and 5, the stationary exercise apparatus 100 comprises first and second supporting members 120*a*/120*b*, each of the first and second supporting members 120*a*/120*b* having a first end portion 153 and a second end portion 154. The first end portions 153 of the first and second supporting members 120*a*/120*b* are respectively coupled to the frame 110 to rotate about the first axis 134. In the preferred embodiment of the present invention, the first end portions 153 of the first and second supporting members 120*a*/120*b* are respectively pivoted to the left and right cranks 132 to rotate about the first axis 134. As mentioned previously, the left and right cranks 132 may be replaced by flywheels or disks and the like. The second end portions 154 of the first and second supporting members 120*a*/120*b* are respectively pivoted to the lower portions of the first and second swing members 149*a*/149*b* so that the second end portions 154 of the first and second supporting members 120*a*/120*b* may be moved along a reciprocating path 190 (as shown in FIGS. 2 and 5) while the first end portions 153 of the first and second supporting members 120*a*/120*b* are being rotated about the first axis 134.

Referring to FIGS. 1 through 6, the stationary exercise apparatus 100 further comprises first and second control links 160*a*/160*b* respectively pivotally connected to the first and second supporting members 120*a*/120*b*. Each of the first and second control links 160*a*/160*b* has a first end portion 155 and a second end portion 156. The first end portions 155 of the first and second control links 160*a*/160*b* are movably coupled to the frame 110. In the preferred embodiment of the present invention, the first end portions 155 of the first and second control links 160*a*/160*b* are respectively connected to first and second handle links 171*a*/171*b*. More specifically, each of the first and second handle links 171*a*/171*b* has lower and upper end portions. The lower end portions 157 of the first and second handle links 171*a*/171*b* are respectively pivoted to the first end portions 155 of the first and second control links 160*a*/160*b* and the upper end portions 158 of the first and second handle links 171*a*/171*b* are pivoted to the frame 110 so that, the first and second handle links 171*a*/171*b* can guide the first end portions 155 of the first and second control links 160*a*/160*b* in a reciprocating path. There are several alternatives of performing the same function of the first and second handle links 171*a*/171*b*. For example, the frame 110 can include a pair of tracks allowing the first end portions 155 of the first and second control links 160*a*/160*b* movably coupled to the tracks via rollers or sliders. For simplicity, all such alternatives are referred to herein as "handle links" even when they do not serve as handles for the user.

Still referring to FIGS. 1 through 6, the stationary exercise apparatus 100 includes first and second pedals 150*a*/150*b* respectively coupled to the first and second supporting members 120*a*/120*b*. In the preferred embodiment of the present invention, the first and second pedals 150*a*/150*b* are indirectly connected to the first and second supporting members 120*a*/120*b*. More specifically, the first and second pedals 150*a*/150*b* are respectively attached to the second end portions 156 of the first and second control links 160*a*/160*b* which are pivotally connected to the first and second supporting members 120*a*/120*b*. Therefore, rear end portions 158 of the first and second pedals 150*a*/150*b* are directed by the first and second supporting members 120*a*/120*b* to move along a second closed path 198 (FIGS. 2, 5, and 6) while the first end portions 153 of the first and second supporting members 120*a*/120*b* rotating about the first axis 134. The first and second pedals 150*a*/150*b* can also be directly attached to the first and second supporting members 120*a*/120*b*, similar to the teaching of U.S. Pat. No. 5,685,804. It should be noticed that both indirect and direct connections between the first and second pedals 150*a*/150*b* and the first and second supporting members 120*a*/120*b* can cause the rear end portions of the first and second pedals 150*a*/150*b* to move along similar closed paths, and are within the scope of the present invention.

Now referring to FIGS. 2 and 5, the reciprocating path 190 of the first and second swing members 149*a*/149*b* has a rear end 192, a front end 194, and a middle point 196. The middle point 196 is substantially the middle point between the rear end 192 and the front end 194. As shown in FIG. 2, the second end portion of the second support member 120*b* is being at the rear end 192 of the reciprocating path 190 while the first end of the second supporting member 120*b* is being approximately at the rearmost position during rotating about the first axis 134. As also shown in FIG. 5, the second end of the second support member 120*b* is being at the front end 194 of the reciprocating path 190 while the first end of the second supporting member 120*b* is being approximately at the foremost position during rotating about the rotating axis 134. In the preferred embodiment of the present invention, the reciprocating path 190 is substantially arcuate because of the swing motion of the first and second swing members 149*a*/149*b*, but the present invention is not limited to an arcuate reciprocating path. It should be noticed that relative positions between the swing axis 159 and the reciprocating path 190 can cause different exercise intensity of the stationary exercise apparatus 100.

More specifically, the positions of the swing axis 159 can determine incline levels of both the reciprocating path 190 and the second closed path 198. If the swing axis 159 is substantially vertically above the middle point 196 of the reciprocating path 190, the incline level of both the reciprocating path 190 and the second closed path 198 are substantially horizontal. If the swing axis 159 is positioned rearwardly in view of an orientation of an operating user, the incline levels of both the reciprocating path 190 and the second closed path 198 are increased. A higher incline level of the second closed path 198 creates higher exercise intensity of a user. As shown in FIG. 2, the swing axis 159 is positioned slightly in back of the middle point 196 of the reciprocating path 190 so that the second closed path 198 is slightly inclined and the exercise intensity is enhanced. In order to obtain higher exercise intensity, the swing axis 159 can be re-positioned farther toward the rear. As shown in FIG. 6, the swing axis 159 is in back of the rear end 192 of the reciprocating path 190 and both the reciprocating path 190 and the second closed path 198 are in a relatively high incline level so that the exercise intensity of the stationary exercise apparatus 100 is further increased.

In a preferred embodiment of the present invention, the adjusting assembly 145 can be controlled via the console 199 to vary the incline level of the second closed path 198 and to adjust the exercise intensity of the stationary exercise apparatus 100. As mentioned previously, the upper portions 150 of the first and second swing members 149*a*/149*b* are coupled to the moving assembly 141 of the frame 110. The adjusting assembly 145 is connected between the lateral link 143 (FIG. 5) of the moving assembly 141 and the frame 110. Therefore, a user can electronically actuate the adjusting assembly 145 to vary the position of the swing axis 159 and adjust the incline level of the second closed path 198. It should be noted that the (lateral) link 143 could be omitted in some embodiments, not shown in the figures. For example, two adjusting assemblies 145 are directly connected to the first and second moving members 142 respectively. The benefit of omitting the (lateral) link 143 is that the height of the first and second pedal 150*a*/150*b* could be lower because of less interference between the (lateral) link 143 and the second end portions of the first and second supporting members 120*a*/120*b*. A user may feel more comfortable in a lower operating position. It should also be noticed that the incline level of the stationary exercise apparatus 100 is not limited to an electronically adjustment. Some manual adjustments, such as pin and holes combinations, levers, cranks and the like are also within the scope of the present invention.

FIG. 5 shows the swing axis 159 is positioned to the rear of the middle point 196 of the reciprocating path 190 and the second closed path 198 is in a low incline level. FIG. 6 shows the swing axis 159 is positioned to the rear of the rear end 192 of the reciprocating path 190 and the second closed path 198 is in a higher incline level. In other embodiments of the present invention, the incline level of the second closed path 198 could also be non-adjustable. For example, the side portions 113 of the frame 110 extend upwardly and the first and second swing members 149*a*/149*b* are directly pivoted to the side portions 113 of the frame 110. In the non-adjustable embodiments, when the swing axis 159 is positioned slightly in back of the middle point 196, the second closed path 198 is in the low incline level, not flat, such as shown in FIG. 5. When the swing axis 159 is positioned in back of the rear end 192 of the reciprocating path 190, the second closed path 198 would be in the high incline level as shown in FIG. 6. Both the low and high incline level of the stationary exercise apparatus 100 can enhance exercise intensity of a user, comparing to a more horizontal incline level To operate the stationary exercise apparatus 100, a user respectively steps on the first and second pedals 150*a*/150*b* and grabs on the fixed handle assembly 180 or a pair of moving handles 172*a*/172*b*. The first end portions 153 of the first and second supporting members 120*a*/120*b* rotate along a substantially arcuate path about the first axis 134 and the second ends of the first and second supporting members 120*a*/120*b* move along the reciprocating path 190. Therefore, rear end portions of the first and second pedals 150*a*/150*b* move along the second closed path 198. As mentioned previously, the positions of the swing axis 159 are relative to some geometry parameters of the second closed path 198 and have great effects on the exercise intensity of a user of the stationary exercise apparatus 100.

Figure 8:
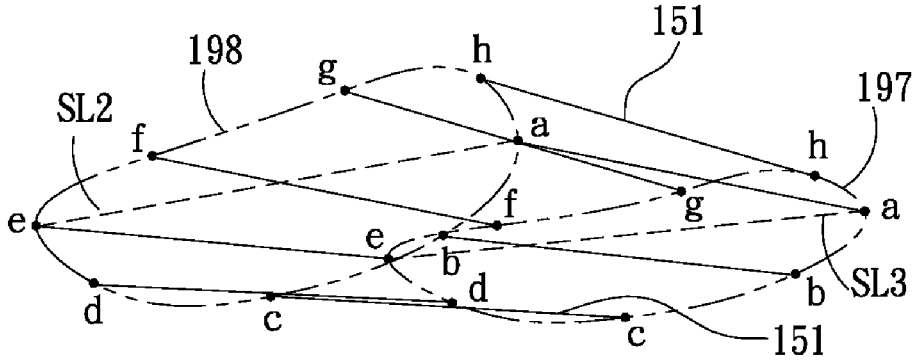
FIG. 8 are toe and heel path profiles of the stationary exercise apparatus of FIG. 1 in a relatively low incline condition.
Figure 9:
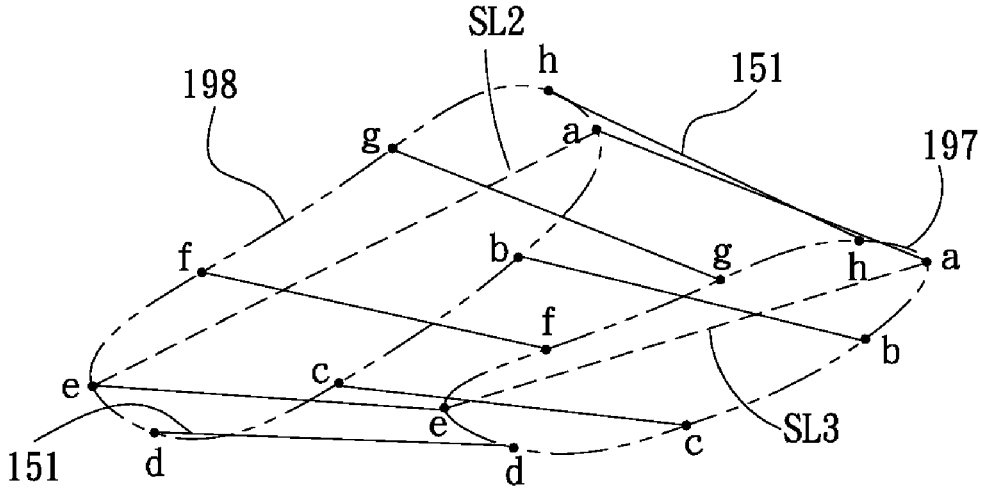
FIG. 9 are toe and heel path profiles of the stationary exercise apparatus of FIG. 1 in a relatively high incline condition.
Figure 10:
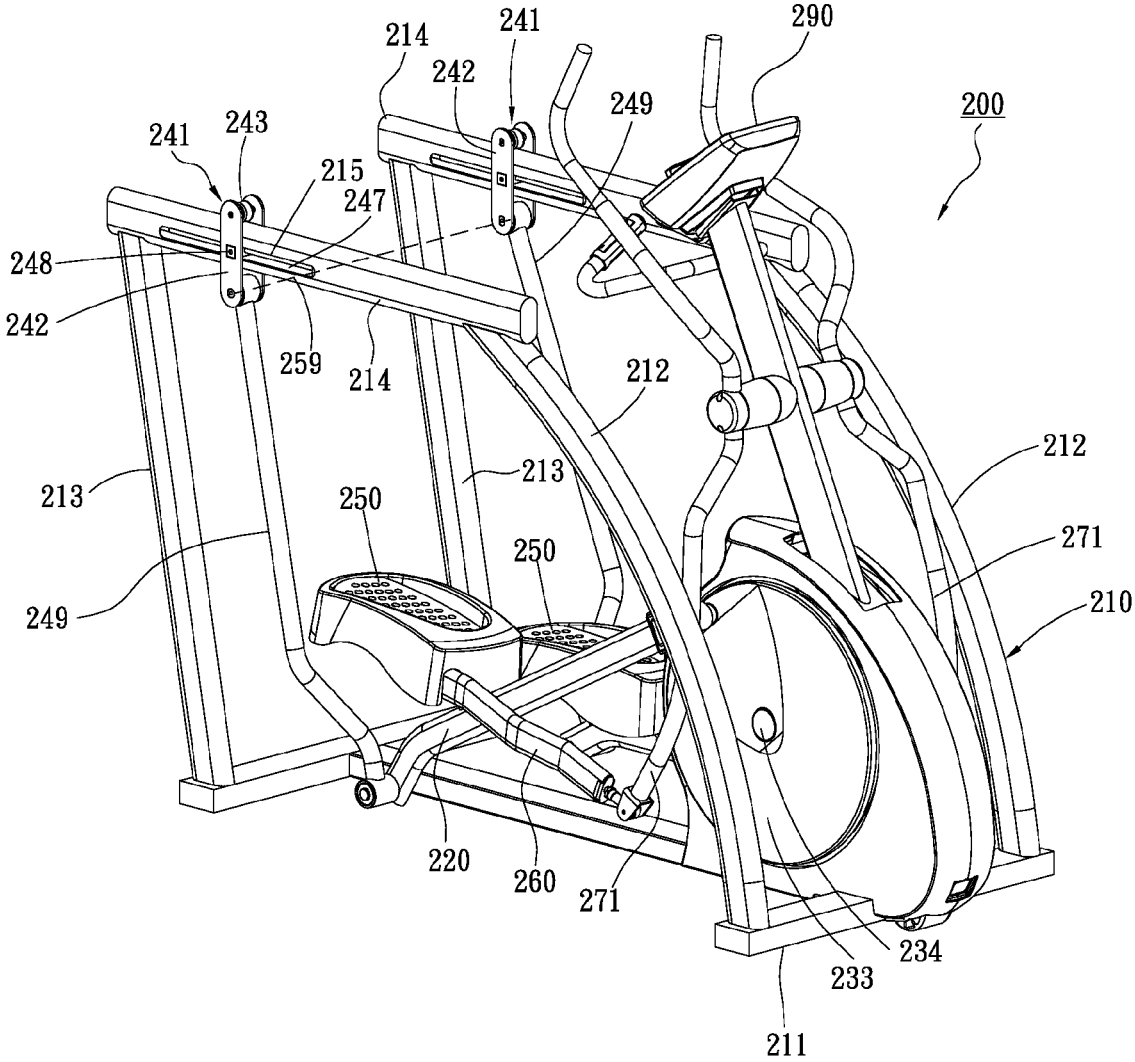
FIG. 10 is a perspective view of a stationary exercise apparatus according to another embodiment of the present invention.
Figure 11:
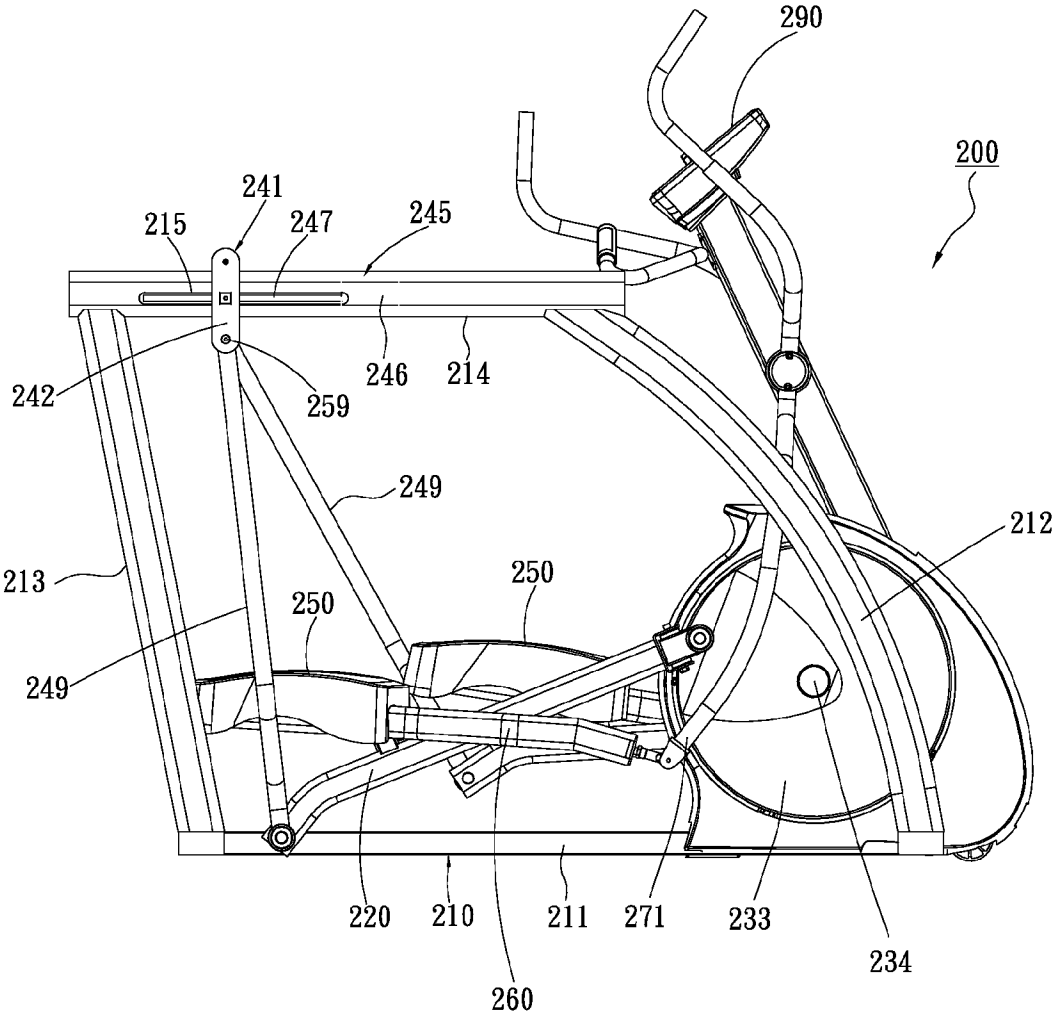
FIG. 11 is a side view of the stationary exercise apparatus of FIG. 10.
Figure 12:
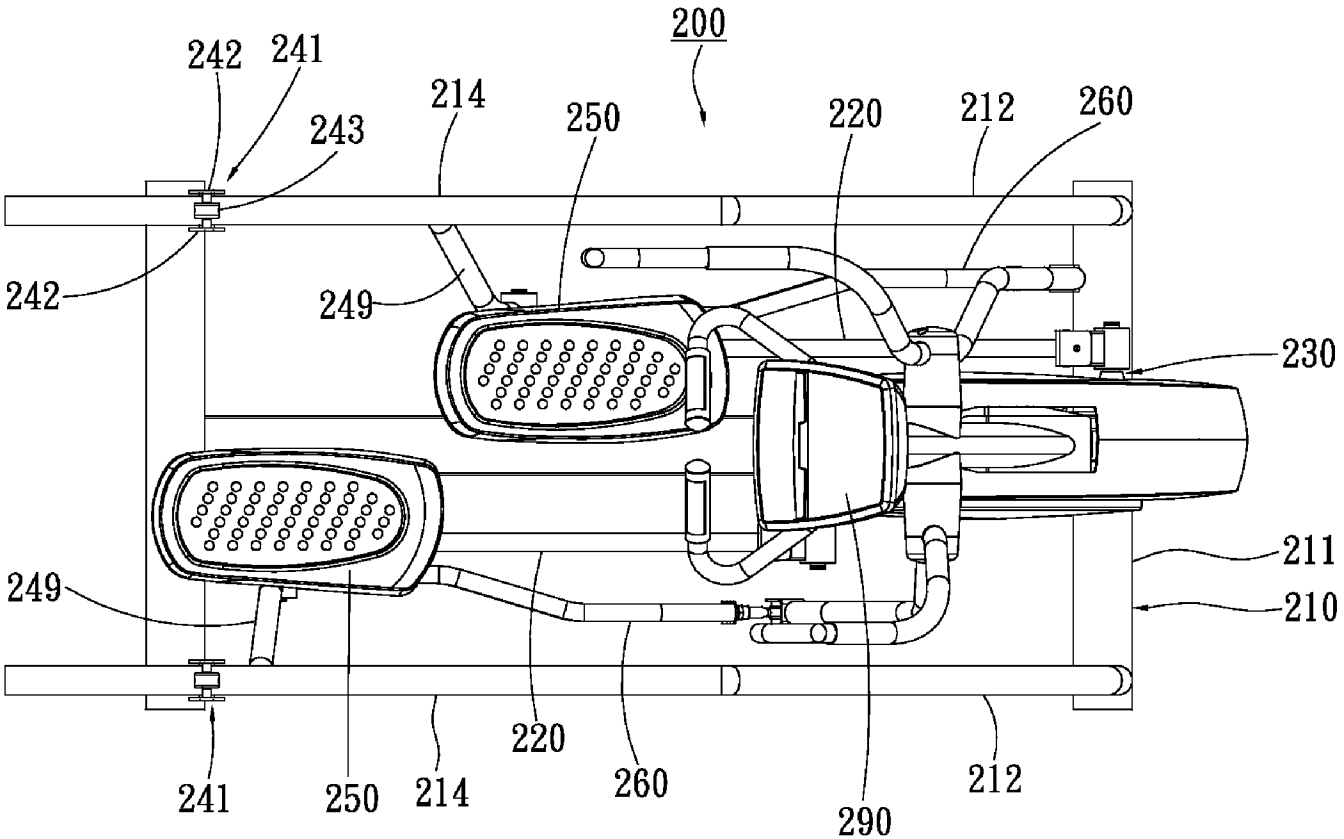
FIG. 12 is a top view of the stationary exercise apparatus of FIG. 10.

To better present the relationship between the swing axis 159 and the second closed path 198, separated path information is illustrated in FIGS. 8 and 9. FIG. 8 shows the path information and geometry parameters while the swing axis 159 is slightly in back of the middle point 196 as shown in FIG. 5. FIG. 9 shows the path information and geometry parameters while the swing axis 159 is to the rear of the rear end 192.

Now referring to FIG. 8 in more detail, the second closed path 198 is represented by eight correspondent points, a through h. The correspondent points a and e are the foremost and rearmost positions of the first ends of the first and second supporting members 120*a*/120*b* during rotating about the first axis 134. Each point is separated in an equal angle of forty-five degrees relative to the angle of rotation about the first axis 134. A stride length SL2 constituted by the correspondent points a and e is also one of the geometry parameters of the second closed path 198, in addition to the incline level. The stride length SL2 is substantially the stride length of the heel portion of a user because the second closed path 198 is the moving path of the rear ends of the pedals 150*a*/150*b* and the heel portion of a user is approximate to the rear ends of the pedals 150*a*/150*b*. Stride length is also relative to exercise intensity. A longer stride length generally results in higher exercise intensity. A third closed path 197 is the moving path of the front ends of the pedals 150*a*/150*b*. A stride length SL3 may also substantially represent the stride length of the toe portion of a user. Because the closed paths 198 and 197 are moving paths of the rear and front ends of the pedals 150*a*/150*b*, the orientation of the pedals 150*a*/150*b* can be illustrated by a pedal orientation 151 as shown in FIG. 8. One important character of the pedal orientation 151 is that the steepness of the pedal orientation 151 is increased when the swing axis 159 is adjusted backwardly.

Figure 7:
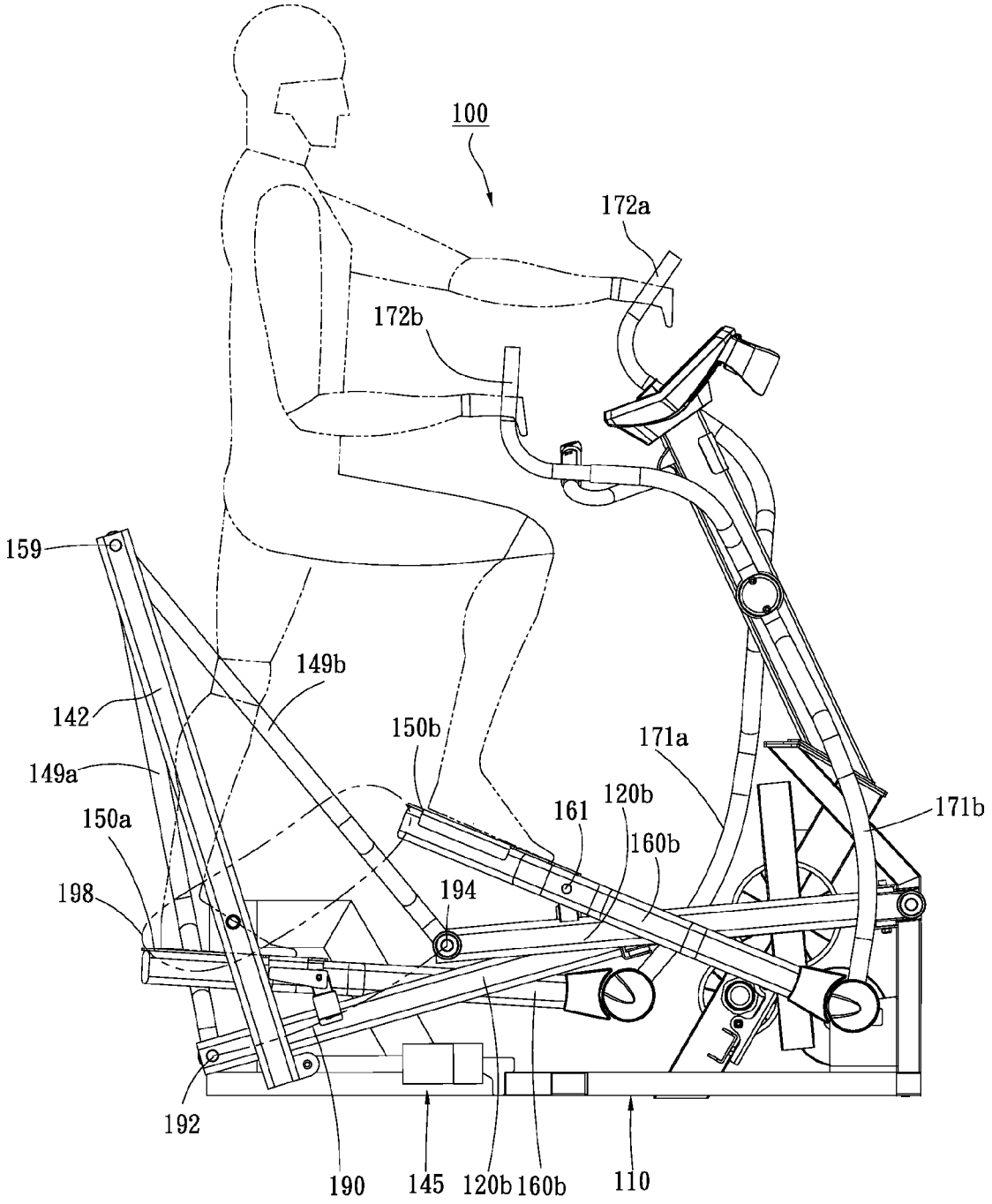
FIG. 7 is a side view of the stationary exercise apparatus of FIG. 1 in another rotating position of the high incline condition demonstrating better gluteus exercise of a user.

Now referring to FIGS. 7 and 9 show the stride length SL2, stride length SL3, pedal orientation 151, second closed path 198, and third closed path 197 while the swing axis 159 is in back of the rear end 192 of the arcuate path 190. As shown in FIG. 7, the first and second control links 160*a*/160*b* are respectively pivoted to the first and second supporting members 120*a*/120*b* via pivot axes 161. The incline level of the second closed path 198 of FIG. 9 is increased by 17 degrees compared to the incline level of FIG. 8, but the incline level of the third closed path 197 of FIG. 9 is only increased by 11 degrees. That is, the incline level of the second closed path 198 is increased more than the incline level of the third closed path 197 while the swing axis 159 is being adjusted backwardly. The stride length SL2 of FIG. 9 is increased by about 15 percent compared to the stride length SL2 as shown in FIG. 8, but the stride length SL3 of FIG. 9 is only increased by about 6 percent. That is, the stride length SL2 is increased more than the stride length SL3 while the swing axis 159 is being adjusted backwardly. Because both path inclination and stride length of the heel portion of a user are increased more than the toe portion, the exercise intensity of the heel portion is higher than the exercise intensity of the toe portion of a user which may also imply a higher exercise intensity of the gluteus of a user. Because the heel portion of the user is obviously elevated as shown in FIG. 7, the thigh of the user is elevated to a substantially horizontal orientation relative to the ground surface so that the gluteus of the user is fully exercised.

Now referring to FIGS. 10 through 13, a second preferred embodiment of the present invention is shown. A stationary exercise apparatus 200 comprises a frame 210 having a base portion 211 adapted to rest on a surface. The frame 210 further comprises a front portion 212 extending upwardly from the base portion 211, a side portion 214 extending longitudinally rearward from the front portion 212, and a rear portion 213 connecting the side portion 214 and the base portion 211.

The stationary exercise apparatus 200 further has first and second supporting members 220, each of the supporting members 220 having a first end portion and a second end portion. The first end portions of the first and second supporting members 220 are respectively pivoted to a pair of rotating members 233 in order to rotate about a first axis 234. The second end portions of the first and second supporting members 220 are respectively connected to the lower portions of first and second swing members 249. The upper portions of the first and second swing members 249 are coupled to the side portion 214 of the frame 210 via a swing axis 259. More specifically, the upper portions of the first and second swing members 249 are pivotally connected to left and right moving assemblies 241.

Each of the left and right moving assemblies 241 respectively comprises third and fourth moving members 242. Each of the third and fourth moving members 242 is connected to left and right adjusting assemblies 245 (FIG. 11) so that the moving assemblies 241 could be driven by the adjusting assemblies 245. Each of the left and right moving assemblies 241 further includes an optional roller 243. The rollers 243 are respectively engaged on the side portion 214 for increasing stability and smoothness of movement of the moving assemblies 241 along the side portion 214.

Figure 13:
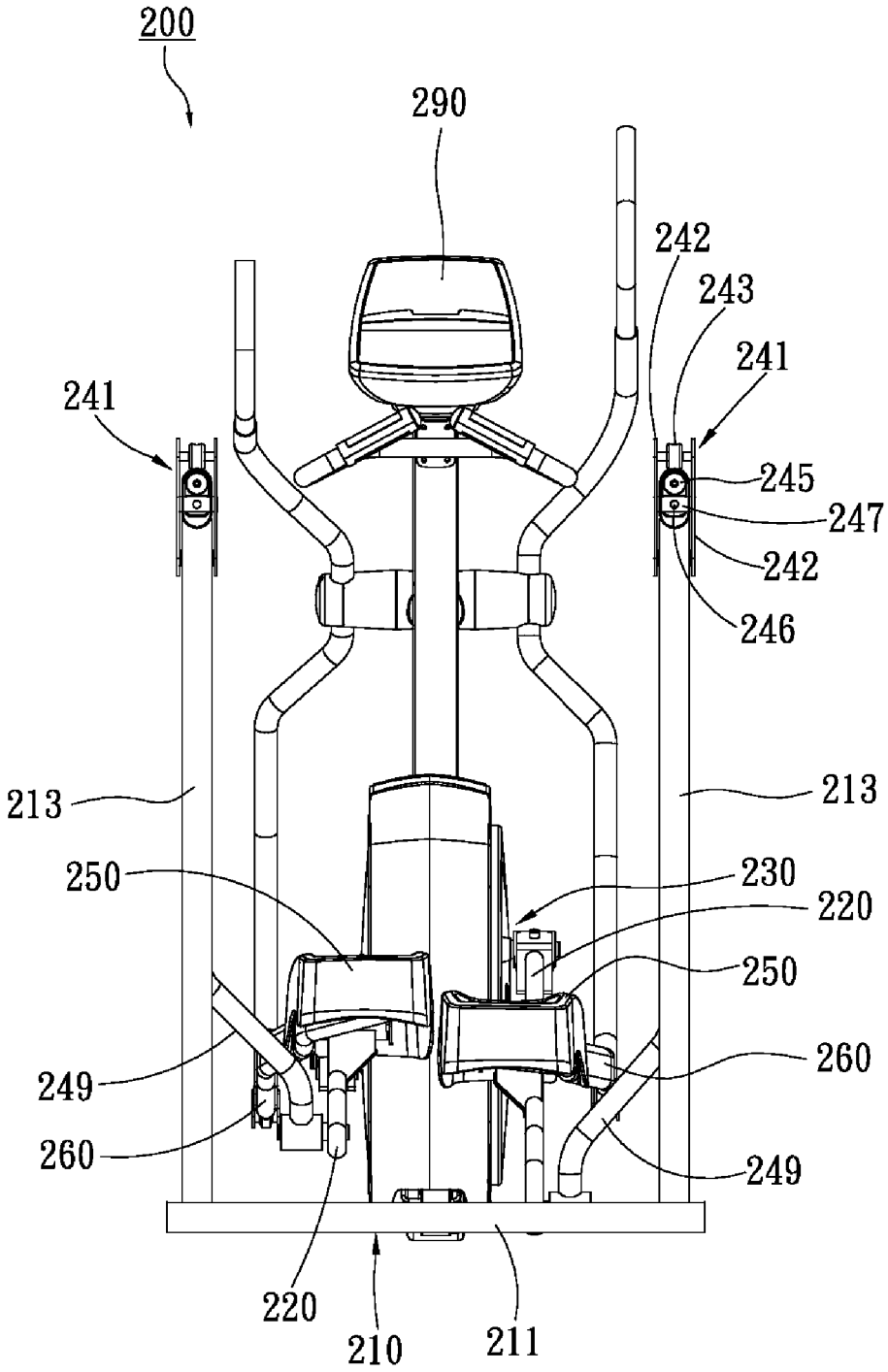
FIG. 13 is a back view of the stationary exercise apparatus of FIG. 10.

As illustrated in FIG. 13, each of the adjusting assemblies 245 includes a motor 246 mounted on one portion of the frame 210, a screw rod 247, and a screw member 248. The screw rod 247 has one end connected to the motor 246 and a portion adapted for movement of the screw member 248. Although described and illustrated as a screw adjusting mechanism, the adjusting assembly 245 could be any manual or automatic mechanical, electromechanical, hydraulic, or pneumatic device and be within the scope of the invention.

In the second preferred embodiment of the present invention, the upper portions of the first and second swing members 249 are respectively pivoted to the third and fourth moving members 242. But, the upper portions of the first and second swing members 249 can also be directly pivoted to the screw members 248 of the adjusting assemblies 245. Therefore, actuating of the motor 246 can cause rotation of the screw rod 247 to change the positions of both the third and fourth moving member 242 and the swing axis 259.

Similar to the previous preferred embodiment of the stationary exercise apparatus 100, the stationary exercise apparatus 200 also comprises a pair of pedals 250 respectively coupled to the supporting members 220. Optionally, the stationary exercise apparatus 200 also has a pair of control links 260 respectively pivoted to the supporting members 220 and a pair of handle links 271 coupled to the frame 210 for guiding the control links 260.

Figure 14:
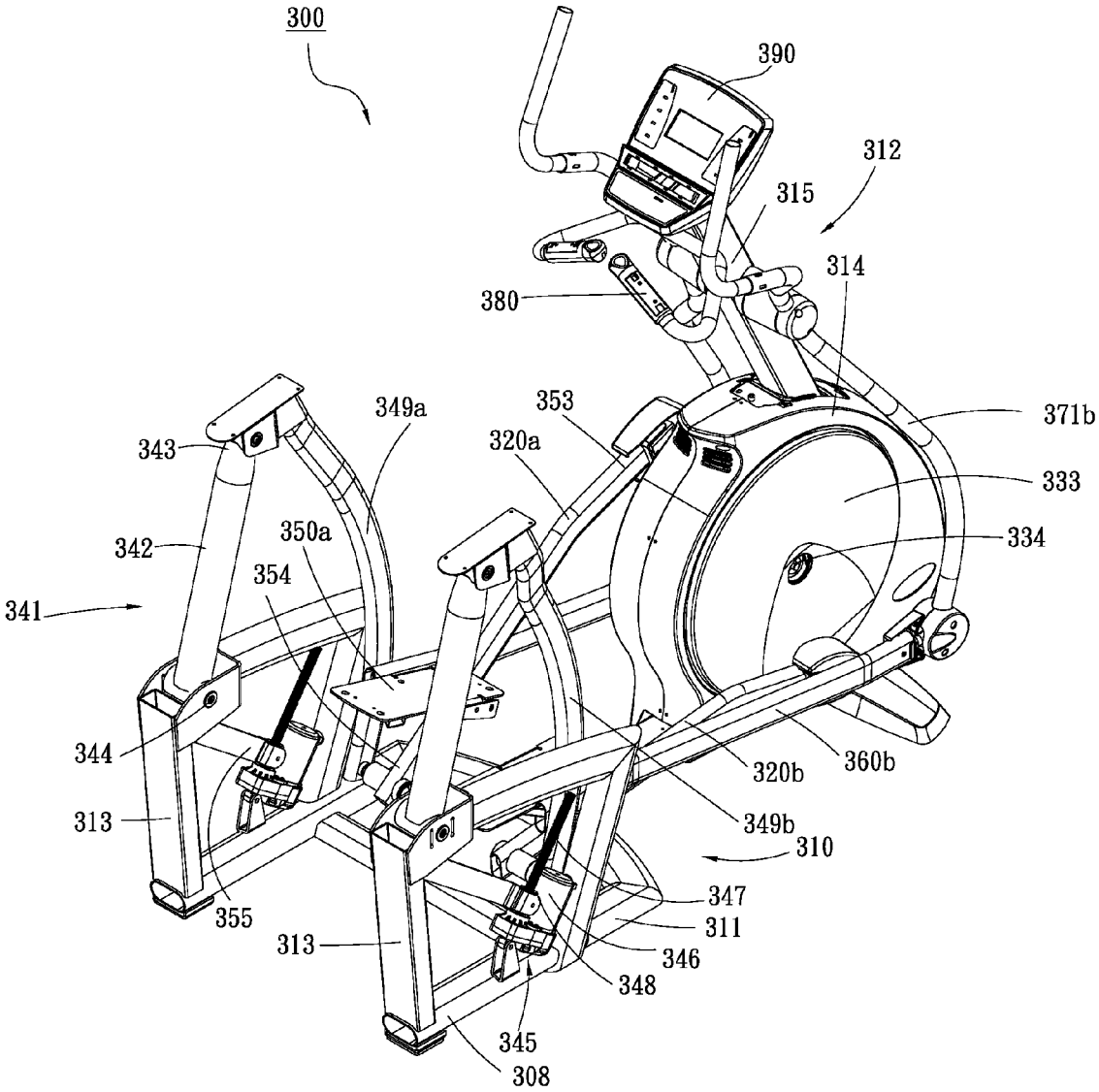
FIG. 14 is a perspective view of a third embodiment of a stationary exercise device in accordance with the present invention.
Figure 15:
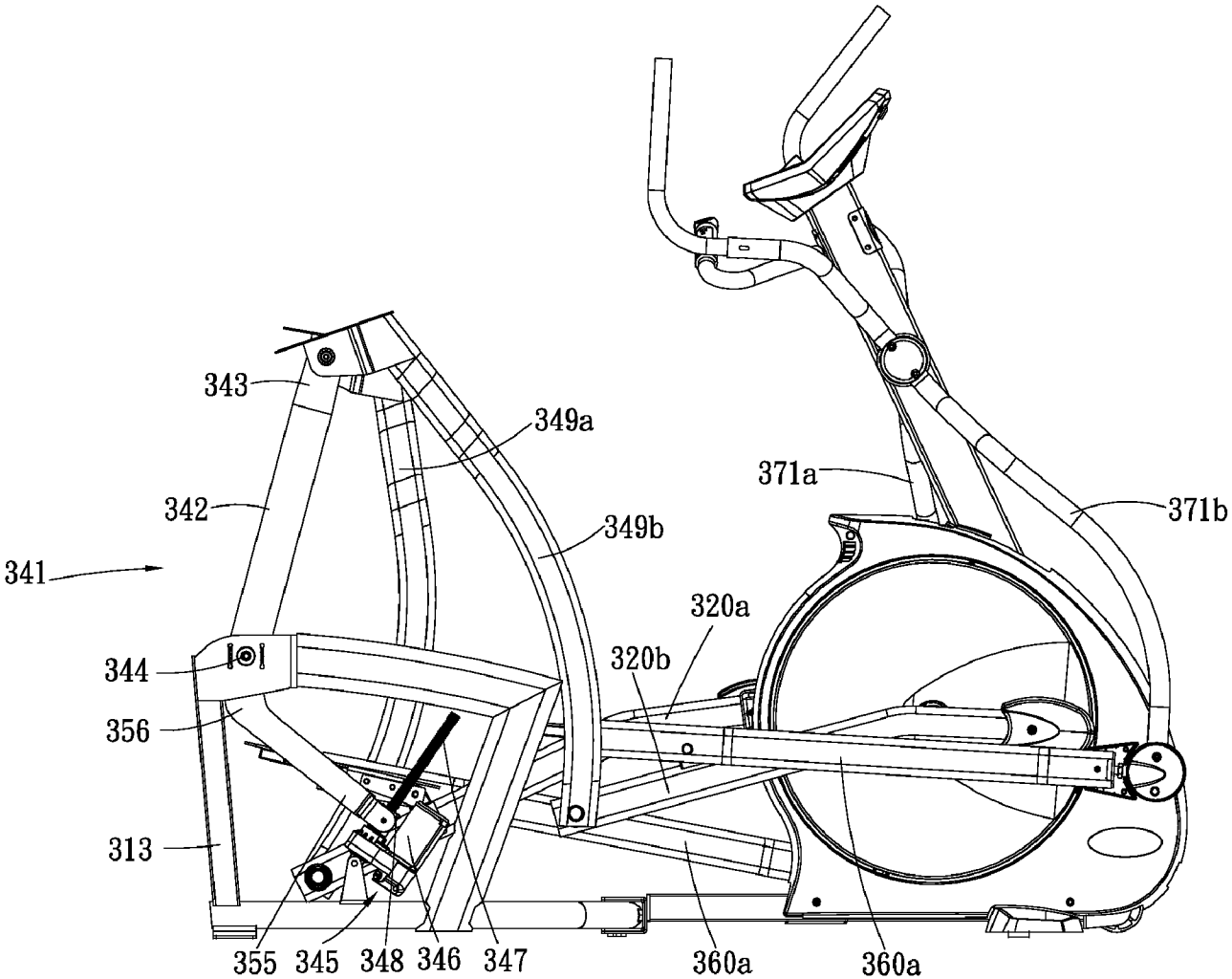
FIG. 15 is a side view of the stationary exercise apparatus of FIG. 14.
Figure 16:
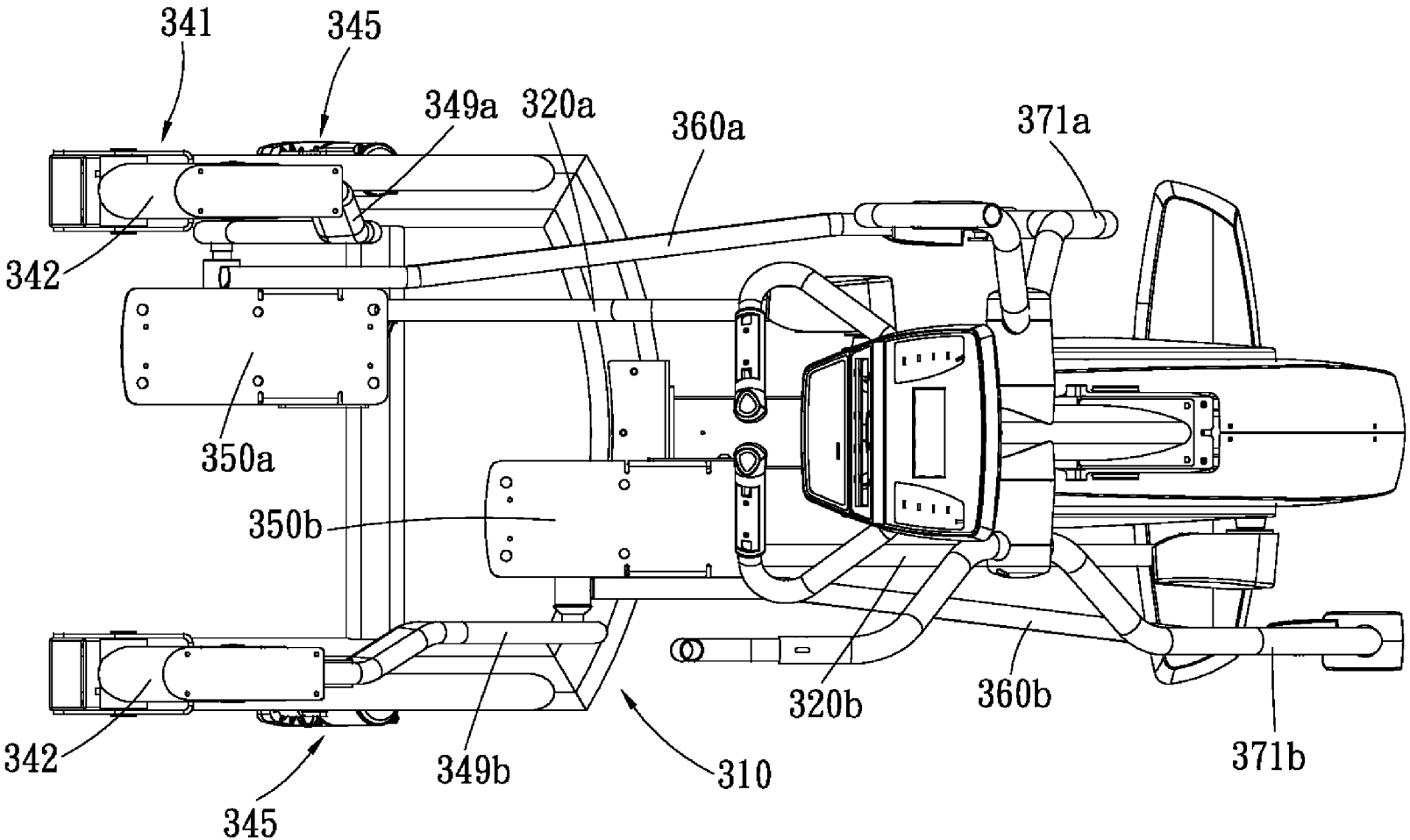
FIG. 16 is a top view of the stationary exercise apparatus of FIG. 14.

FIGS. 14 through 16 illustrate an embodiment similar to the embodiment illustrated in FIGS. 1 though 9. This third embodiment of a stationary exercise apparatus 300 includes a frame 310 having a base 311, a front portion 312, a rear portion 308, and side portions 313. The frame 310 may also include a post 314 and a standard 315. A handle assembly 380 and a console 390 are also provided as described above in relation to the first and second embodiments.

The third embodiment of the exercise apparatus 300 includes rotating members 333 that rotate about a first axis 334, similar to those described and illustrated in relation to the second embodiment 200 (FIGS. 10 through 13). An optional resistance member 135 is also provided.

Similar to the embodiment illustrated in FIGS. 1 to 9, the third embodiment of the exercise apparatus 300 also includes first and second supporting members 320*a*/320*b*, each having a first end portion 353 rotatably joined to the rotating members 333 and a second end portion 354. The second end portions 354 are respectively joined to swing members 349*a*/349*b*. The swing members 349*a*/349*b* are joined to the frame side portions 313 in a manner substantially similar to that described above in relation to the first embodiment 100.

There is also provided a moving assembly 341 including first and second moving member 342 that are defined by an upper portion 343 and a lower portion 355 joined at an elbow 356, so that the upper portion 343 and the lower portion 355 are at an angle to one another as illustrated. The first and second moving members 342 are joined to the side portions 313 via a second axis 344 to pivot as described above.

An optional adjusting assembly 345 is provided on each side of this embodiment. The adjusting assembly 345 activates the moving assembly 341 about the second axis 344. The adjusting assembly includes a motor 346, a screw rod 347, and a threaded nut, sleeve, or tube 348. The motor 346 is connected to the base 311 and to the screw rod 347. In this embodiment, the screw rod 347 is generally upright and angled slightly forward. The screw rod 347 is threaded through the tube 348, which is pivotally mounted on the lower portion 355 of the moving members 342. In this manner, the motor 346 can be activated automatically or manually from the console 390 to rotate the screw rod 347, which in turn raises or lowers the tube 348 along the screw rod 347. As the tube 348 is raised or lowered, the moving member 342 pivots about the second axis 344. A manually operated adjusting assembly could also be used, as described above.

In this embodiment of the exercise apparatus 300, the swing members 349*a*/349*b* are illustrated as arcuate in shape so that the support members 320*a*/320*b* need not extend rearwardly as far as those illustrated in previous embodiments. Otherwise, the operation of the swing member 349*a*/349*b* and the support members 320*a*/320*b* are essentially as described above.

First and second pedals 350*a*/350*b* are respectfully coupled to the first and second supporting members 320*a*/320*b*, either directly or indirectly. To couple the pedals 350*a*/350*b* indirectly to the support members 320*a*/320*b*, there are provided first and second control links 360*a*/360*b* which are pivotally connected to the support members 320*a*/320*b*. The pedals 350*a*/350*b* are joined to the control links 360*a*/360*b* and move in a second closed path when the support members 320*a*/320*b* move as described above.

Handle links 371*a*/371*b* are illustrated for this embodiment, and as with the above embodiments, may be substituted by tracks, rollers, sliders, and the like to provide support for the moving first end portions of the control links 360*a*/360*b*. Any such device is referred to herein as a "handle link" regardless of whether it actually serves as a handle for a user.

Figure 17:
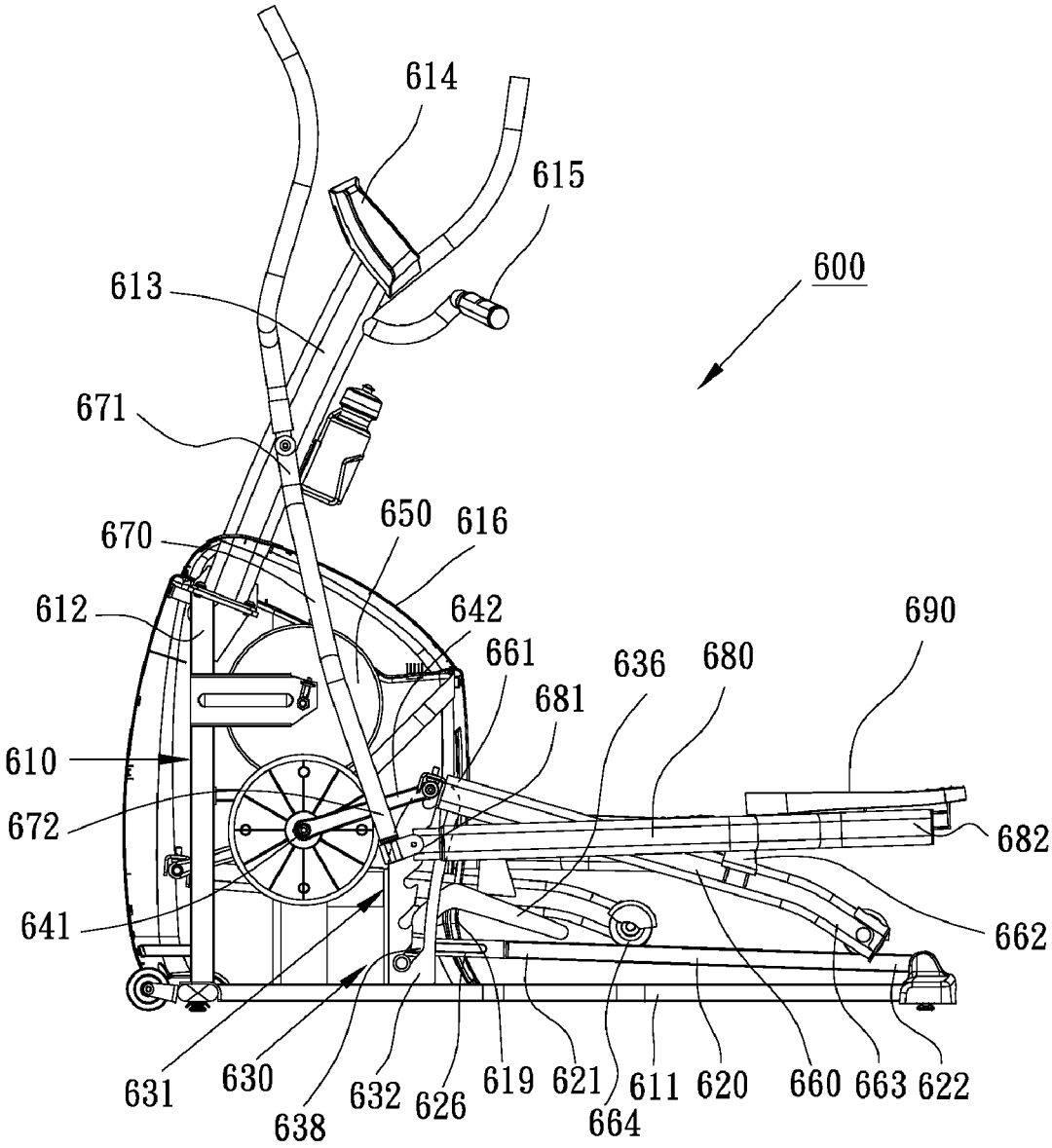
FIG. 17 is a left side view of a fourth embodiment of a stationary exercise device in accordance with the present invention in a relatively low incline condition.
Figure 18:
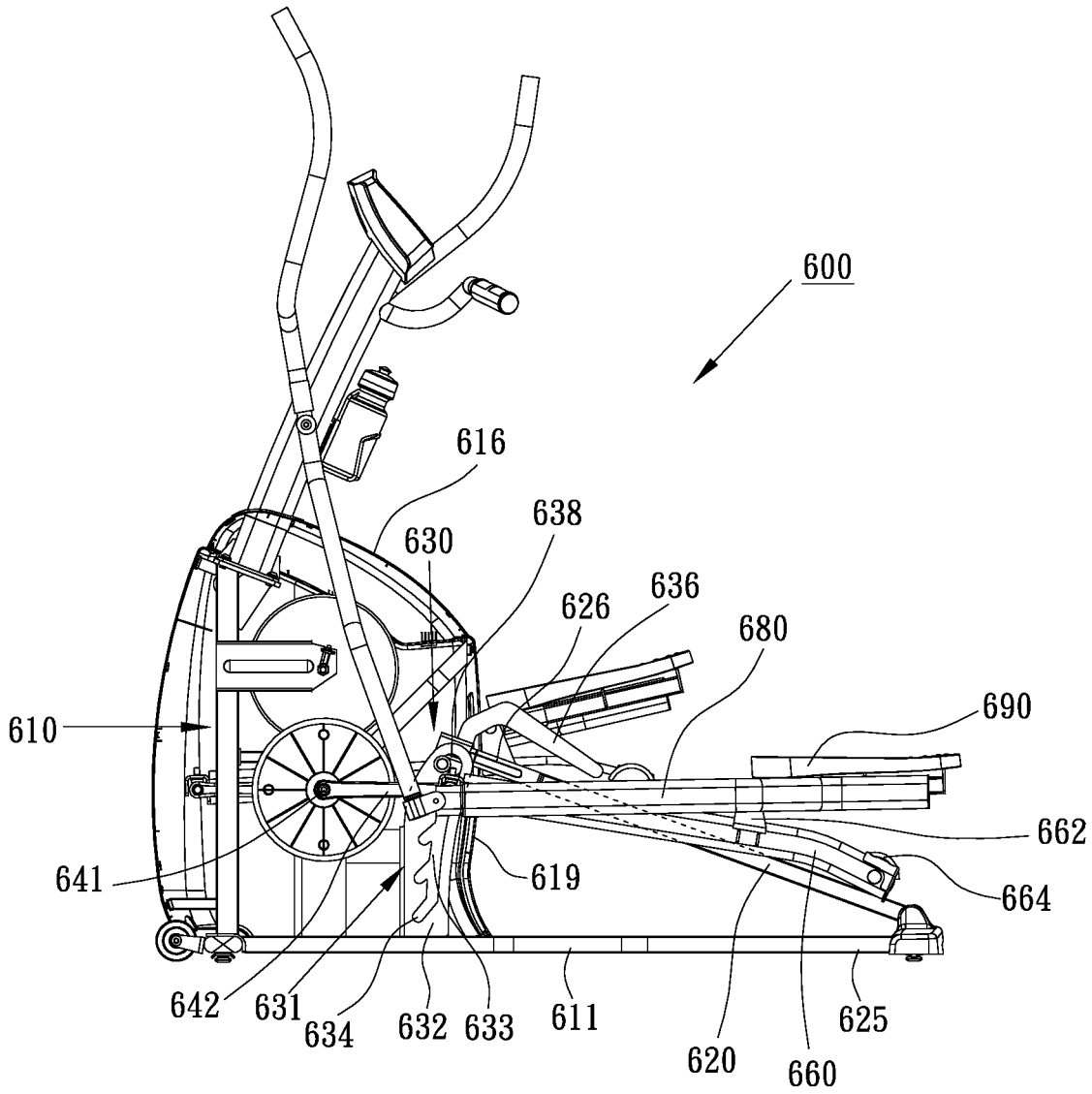
FIG. 18 is a left side view of the stationary exercise apparatus of FIG. 17 in a relatively high incline condition.

FIGS. 17 through 18 illustrate an embodiment having substantial portions similar to the embodiments illustrated in FIGS. 1 though 16. This embodiment of a stationary exercise apparatus 600 includes a frame 610 having a base 611 and a rear portion 625 (FIG. 18). The frame 610 may also include a front portion having a post 612 and a standard 613. A fixed handle assembly 615 and a console 614 are also provided as described above in relation to the previous embodiments.

The embodiment of the exercise apparatus 600 includes rotating members 642 that rotate about a first axis 641, similar to those described and illustrated in relation to the first embodiment 100 (FIGS. 1 and 2). In this embodiment of the exercise apparatus 600, the rotating members 642 are a pair of cranks. An optional resistance assembly 650 is also provided.

Similar to the embodiment illustrated in FIGS. 1 to 9, the embodiment of the exercise apparatus 600 also includes first and second supporting members 660, each having a first end portion 661 rotatably joined to the rotating members 642 and a second end portion 663 preferably being coupled with a roller 664 (FIG. 18) or slider for reciprocating movements on a guider 620. In a preferred embodiment of FIG. 17, the guider 620 for reciprocating movements of the second end portions 663 of the first and second supporting members 660 is a track having a surface thereon for being engaged by the supporting members 660.

Figure 19:
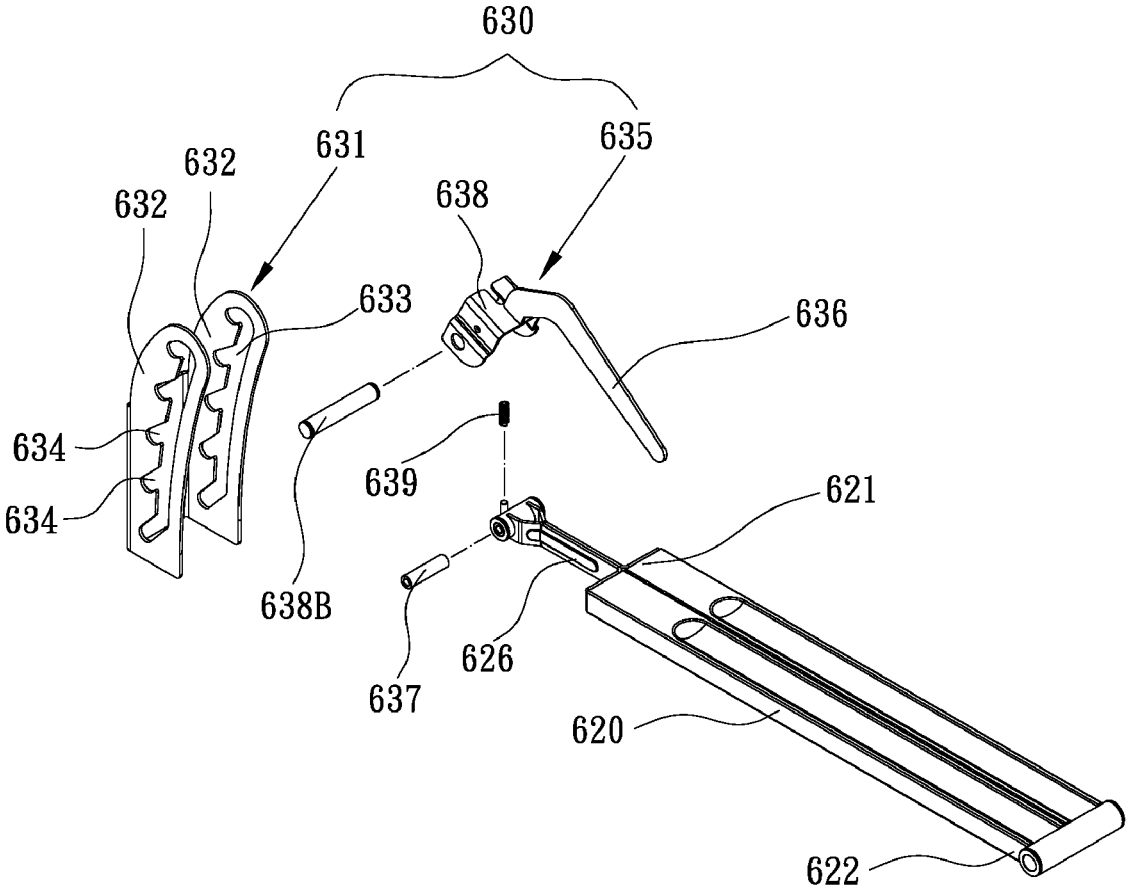
FIG. 19 is an exploded view of the elevating assembly of the stationary exercise apparatus of FIG. 17.

Now referring to FIGS. 17 through 19, the guider 620 has a first end portion 621 and a second end portion 622 pivotally connected to the rear portion 625 of the base 611. The guider 620 may further comprise an extending piece 626 extending from the first end portion 621 of the guider 620. As shown in FIG. 19, the extending piece 626 is a relatively long and thin member for penetrating a slot 619 positioned on the rear portion of a shroud 616. The shroud 616 is mounted on the base 611 for covering some mechanisms such as the resistance assembly 650 in order to provide a succinct appearance of the exercise apparatus 600. Because of the long and thin feature of the extending piece 626, the slot 619 for penetration of the extending piece 626 also has a slender feature. The succinct appearance of the exercise apparatus 600 is therefore maintained because of the existence of the slot 619.

An exploded view of an elevating assembly 630 of the embodiment of FIG. 17 is shown in FIG. 19. The elevating assembly 630 is coupled between the guider 620 and the frame 610. More specifically, the elevating assembly 630 comprises a supporting bracket 631 mounted on the base 611 and an actuating mechanism 635 coupled to the first end portion 621 of the guider 620. In the preferred embodiment of FIG. 17, the supporting bracket 631 comprises at least an upright piece 632 extending upward from the base 611, an adjusting path 633 conforming to a path of the first end portion 621 of the guider 620 as rotated about the second end portion 622 of the guider 620, and a plurality of receiving portions 634 positioned on the upright piece 632. As shown in FIG. 19, there are respectively five receiving portions 634 on each of the upright pieces 632. Therefore, the guider 620 could be adjusted to five different incline levels by selectively engaging the actuating mechanism 635 with the supporting bracket 631 in the illustrated embodiment, but more or fewer receiving portions could be used in alternate embodiments.

The actuating mechanism 635 may include a positioning member 638 pivotally connected to the first end portion 621 of the guider 620 via an axis 637, a positioning pin 638B mounted on the positioning member 638, and an actuating grip 636 connected to the positioning member 638. The actuating grip 636 and the positioning pin 638B are at the opposite side relative to the axis 637.

Figure 20:
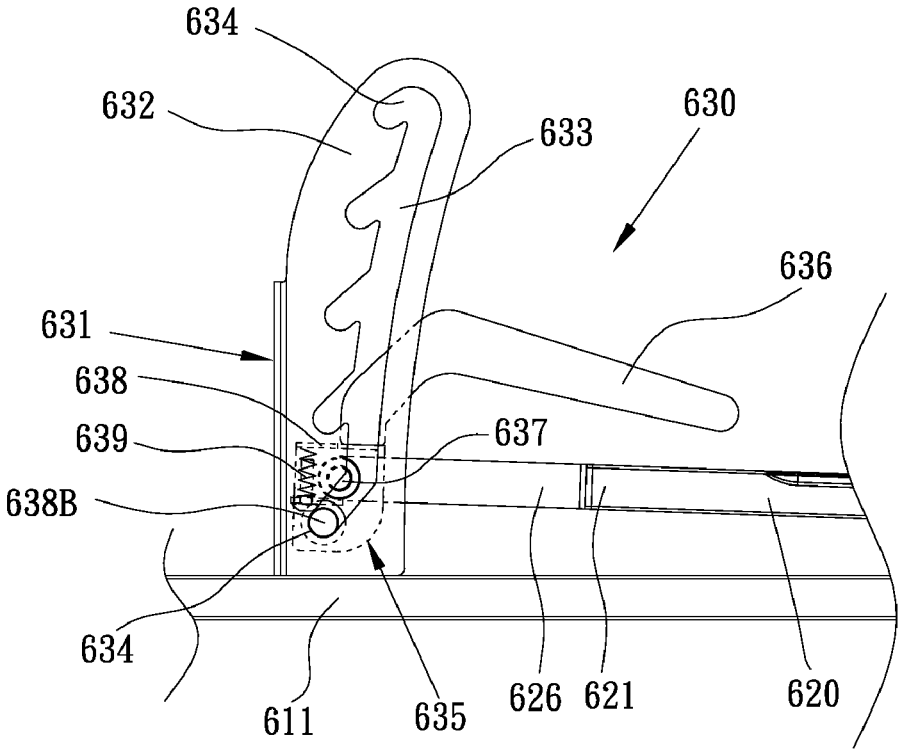
FIG. 20 is a left side view of the elevating assembly of the stationary exercise apparatus of FIG. 17.
Figure 21:
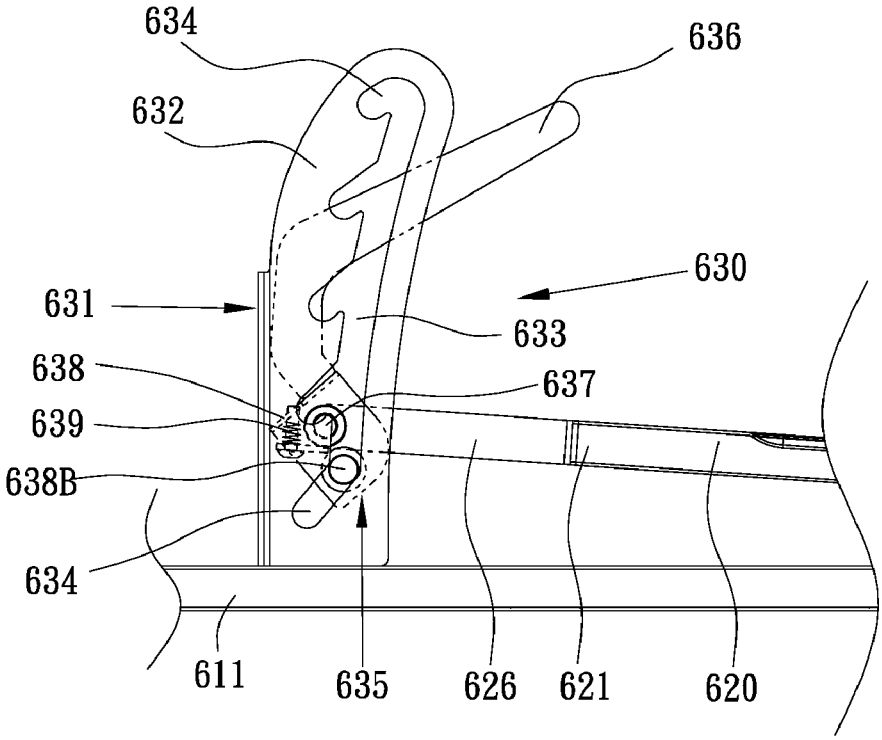
FIG. 21 is a left side view of the elevating assembly of the stationary exercise apparatus of FIG. 17 with the elevating assembly actuated.

Now referring to FIGS. 20 and 21, the operation of the actuating mechanism 635 is illustrated. Initially, the positioning pin 638B is engaged with one of the receiving portions 634. Since the positioning member 638 is pivotally connected to the first end portion 621 of the guider 620 via the axis 637, a user can pull up the actuating grip 636 to pivot (rotate counterclockwise about the axis 637) the positioning member 638 around the axis 637. Therefore, the positioning pin 638B can depart from the receiving portions 634 and moved into the adjusting path 633 of the supporting bracket 631 when the user pulls up the actuating grip 636. In other words, the positioning pin 638B is moved counterclockwise along an short arc path (not shown) to disengage from the receiving portions 634. After the positioning pin 638B is removed from one of the receiving portions 634, the user can select a desired incline level of the guider 620 and lift or lower the guider 620 by moving the positioning pin 638B along the adjusting path 633 of the supporting bracket 631, then push down the actuating grip 636 in order to engage the positioning pin 638B with any one of the receiving portions 634 again.

Alternative elevating assemblies 630 may also be used within the scope of the present invention. For example, in the embodiment of FIG. 19, the receiving portions 634 are depicted as notches, but could be replaced by a plurality of receiving pins (not illustrated) and the positioning member 638 can directly engage the receiving pins. The positioning pin 638B of the positioning member 638 is not necessary for this alternative receiving pin embodiment. The positioning member 638 may further comprise a notch located on the bottom of the front portion of the positioning member 638 for engaging the receiving pins for increasing the stability of the engaging status.

An optional resilient member 639 for facilitating operation of the actuating mechanism 635 is shown in FIGS. 19 through 21. The resilient member 639 has one end attached to the first end portion 621 of the guider 620, and the other end engaged with the positioning member 638. When a user pulls up the actuating grip 636, the resilient member 639 is compressed and energized. While the user pushes down the actuating grip 636 to engage the positioning pin 638B with one of the receiving portions 634 again, the compressed resilient member 639 (FIG. 21) can release the stored energy to facilitate the engagement between the positioning pin 638B and the receiving portions 634. In the illustrated embodiment, the resilient member 639 is a spring, but various types and materials of resilient members could be used.

Figure 22:
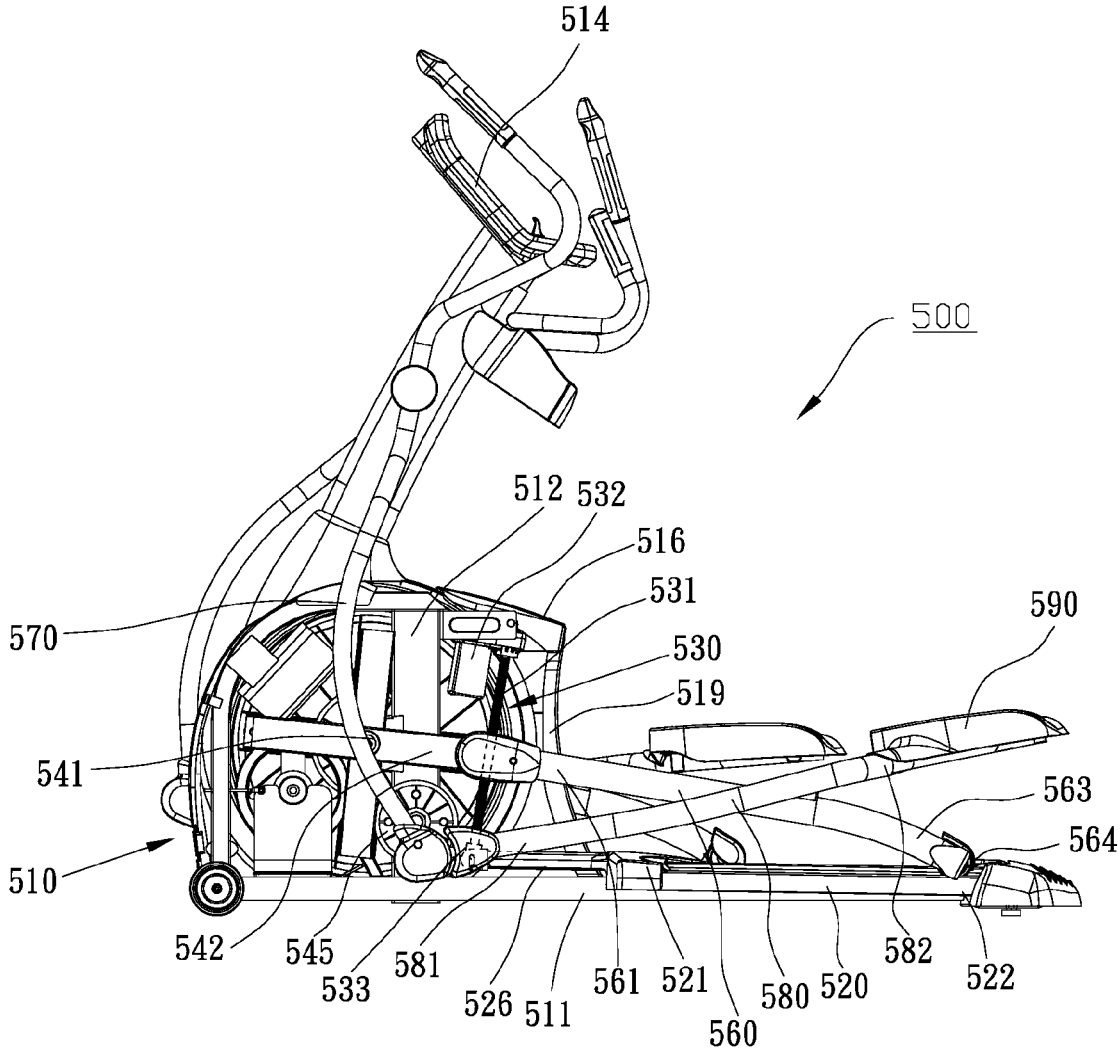
FIG. 22 is a left side view of a fifth embodiment of a stationary exercise device in accordance with the present invention in a relatively low incline condition.
Figure 23:
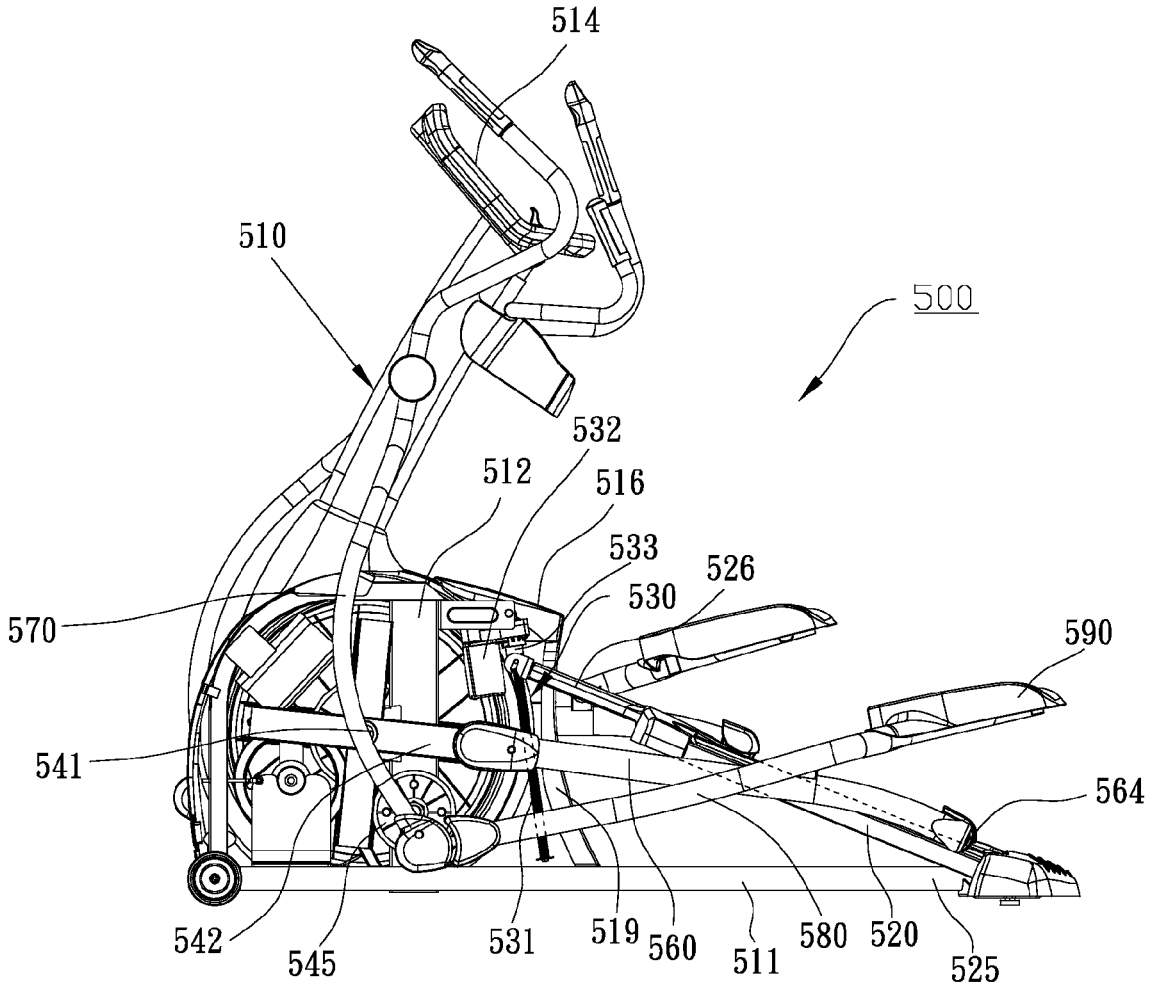
FIG. 23 is a left side view of the stationary exercise apparatus of FIG. 17 in a relatively high incline condition.

FIGS. 22 and 23 illustrate an embodiment of an exercise apparatus 500 having substantial portions similar to the embodiment illustrated in FIGS. 17 and 18. The exercise apparatus 500 generally comprises a frame 510, first and second supporting members 560, first and second pedals 590 respectively coupled to the first and second supporting members 560, a guider 520 coupled to the base 511, and an elevating assembly 530 coupled between the guider 520 and the frame 510 for adjusting the incline level of the guider 520. The frame 510 comprises a base 511, a front portion 512, and a rear portion 525. Each of the first and second supporting members 560 has a first end portion 561 and a second end portion 563, with the first end portions 561 of the first and second supporting members 560 respectively coupled to the frame 511 to rotate about a first axis 541 similar to described previously. The second end portions of the supporting members preferably having rollers 564. The guider 520 has a first end portion 521 and a second end portion 522, the second end portion 522 of the guider 520 pivotally connected to the rear portion 525 (FIG. 23) of the base 511. The second end portions 563 of the first and second supporting members 560 are respectively reciprocated on the guider 520.

The major difference between the embodiments of FIGS. 17 and 22 is the elevating assembly. The elevating assembly 530 of the exercise apparatus 500 is a screw-type elevating assembly. More specifically, the elevating assembly 530 comprises a screw rod 531 pivotally connected to the frame 510, a motor 532 coupled to the screw rod 531, and a tube 533 threaded by the screw rod 531. The tube 533 can be moved along the screw rod 531 when the motor 532 drives the screw rod 531 to rotate. The guider 520 may further comprise an extending piece 526 extruding from the first end portion 521 of the guider 520. In the preferred embodiment of FIG. 22, the tube 533 is pivotally connected to the extending piece 526. But, it is understood by people skilled in the art that the tube 533 can be directly pivotally connected to the first end portion 521 of the guider 520 and not connected to the extending piece 526, and still be within the scope of the present invention.

Similar to the embodiment of FIG. 17, the extending piece 526 also has a long and thin feature for penetrating a slot 519 positioned on the rear portion of a shroud 516 which is mounted on the base 511. Because of the slender feature of both the extending piece 526 and the slot 519, the shroud 516 of the exercise apparatus 500 would present a succinct and harmonious in appearance.

FIG. 22 illustrates that the guider 520 of the exercise apparatus 500 is in a relatively low incline condition. When a user wants to adjust the incline level of the guider 520 from the relative low incline level shown in FIG. 22 to a relatively high incline level shown in FIG. 23. The user could actuate the motor 532 via a console 514. Since the motor 532 is coupled to the screw rod 531, the screw rod 531 could be driven by the motor 532 for rotation. The rotation of the screw rod 531 moves the tube 533 upwardly. Therefore, the guider 520 is adjusted to the relatively high incline condition. Since the screw rod 531 is pivotally connected to the frame 510 and the tube 533 is also pivotally connected to the extending piece 526, the screw rod 531 could be pivoted rearward when the tube 533 is moved upwardly as shown in FIG. 23.

Now referring to FIGS. 22 and 23, first and second pedals 590 are respectfully coupled to the first and second supporting members 560, either directly or indirectly as described above. To couple the pedals 590 indirectly to the support members 560, there are provided first and second control links 580 which are pivotally connected to the supporting members 560. The pedals 590 are joined to the control links 580 and move in a second closed loop path 598 and a third closed loop path 597 (FIGS. 24 and 25) when the supporting members 560 move as described above.

Handle links 570 are illustrated for this embodiment, and as with the above embodiments, may be substituted by tracks, rollers, sliders, and the like to respectively provide support for the moving of first end portions 581 of the control links 580. Any such device is referred to herein as a "handle link" regardless of whether it actually serves as a handle for a user.

Figure 24:
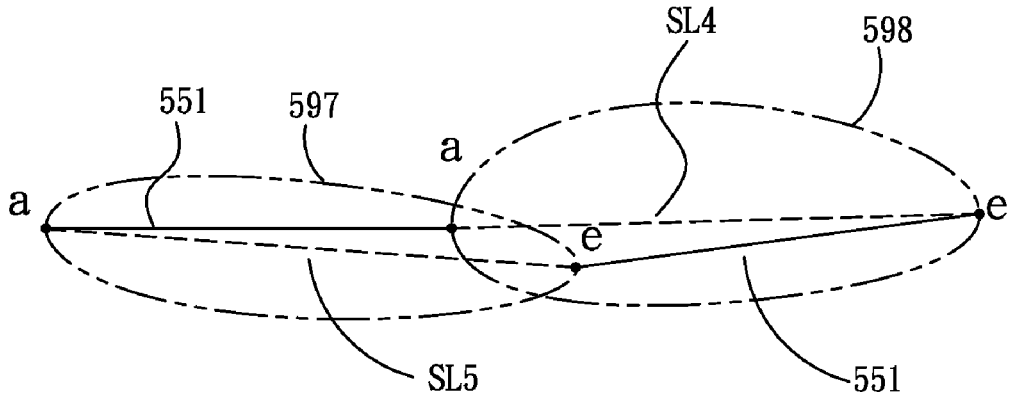
FIG. 24 is toe and heel path profiles of a user of the stationary exercise apparatus of FIG. 22 in a relatively low incline condition.
Figure 25:
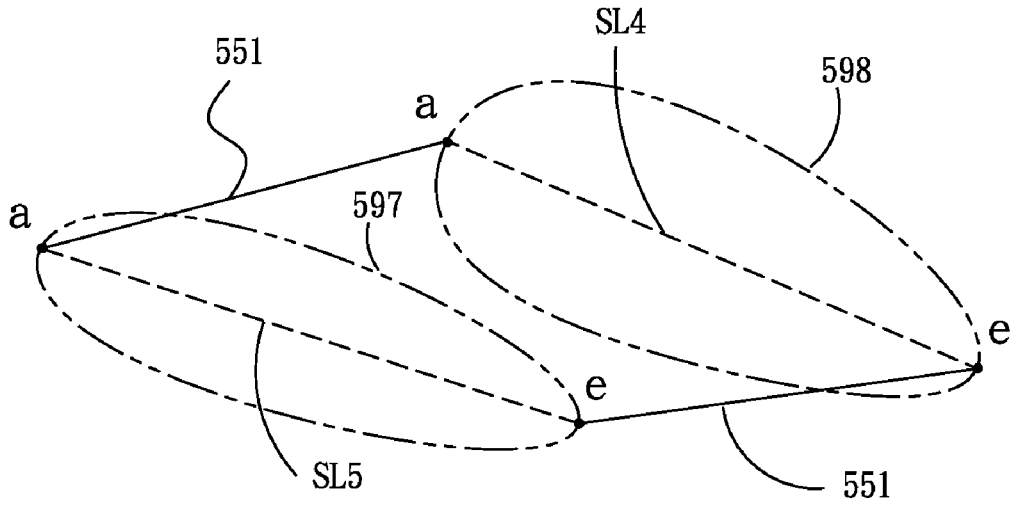
FIG. 25 is toe and heel path profiles of a user the stationary exercise apparatus of FIG. 22 in a relatively high incline condition.

FIGS. 24 and 25 are path profiles and information of the stationary exercise apparatus 500 when the guider 520 is in the relatively low and high incline conditions, respectively. The points a and e correspond to the foremost and rearmost positions when the first ends of the first and second supporting members 560 are rotating about the first axis 541. Similar to the embodiments described above, second and third closed loop paths 598/597 respectively represent the moving paths of the heel and toe portions of a user of the stationary exercise apparatus 500; stride lengths SL4 and SL5 are respectively representing the stride lengths of the heel and toe portions of a user of the stationary exercise apparatus 500 similar to the description of FIG. 9.

Stride length is related to exercise intensity, and a longer stride length generally results in higher exercise intensity. In FIG. 24, the stride length SL4 is substantially the same with the stride length SL5, but the stride length SL4 is longer than the stride length SL5 in FIG. 25 when the stationary exercise apparatus 500 is in the relatively high incline condition. That is, the stride length increases from the stride length SL5 to the length of the stride length SL4 as the guider 520 is adjusted from a relatively low incline condition to a relatively high incline condition. Therefore, the heel portion and gluteus portion of a user have a higher exercise intensity when the stationary exercise apparatus 500 is in the relatively high incline condition.

The orientation of the pedals 590 can be simply illustrated by a pedal orientation 551 as shown in FIGS. 24 and 25, a connection between front and rear ends of the pedals 590. One important character of the pedal orientation 551 in the foremost position a is that the steepness of the pedal orientation 551 is increased forwardly when the guider 520 is adjusted from the relatively low incline condition to the relatively high incline condition. That is, in the foremost position a, the rear end portion of the pedal 590 moves upwardly at a faster rate than the front end portion of the pedals 590 when the guider 520 is adjusted from the relatively low incline condition to the relative high incline condition. In the foremost position a, the rear end portion of the pedal 590 is moved higher than the front end portion of the pedals 590 when the incline level of the guider 520 is increased. Since the steepness, in the foremost position a, of the pedal orientation 551 is more obvious in the relatively high incline condition, the heel portion of a user is elevated more obviously than the toe portion of a user, therefore the gluteus of the user is more fully exercised as described above.

Figure 26:
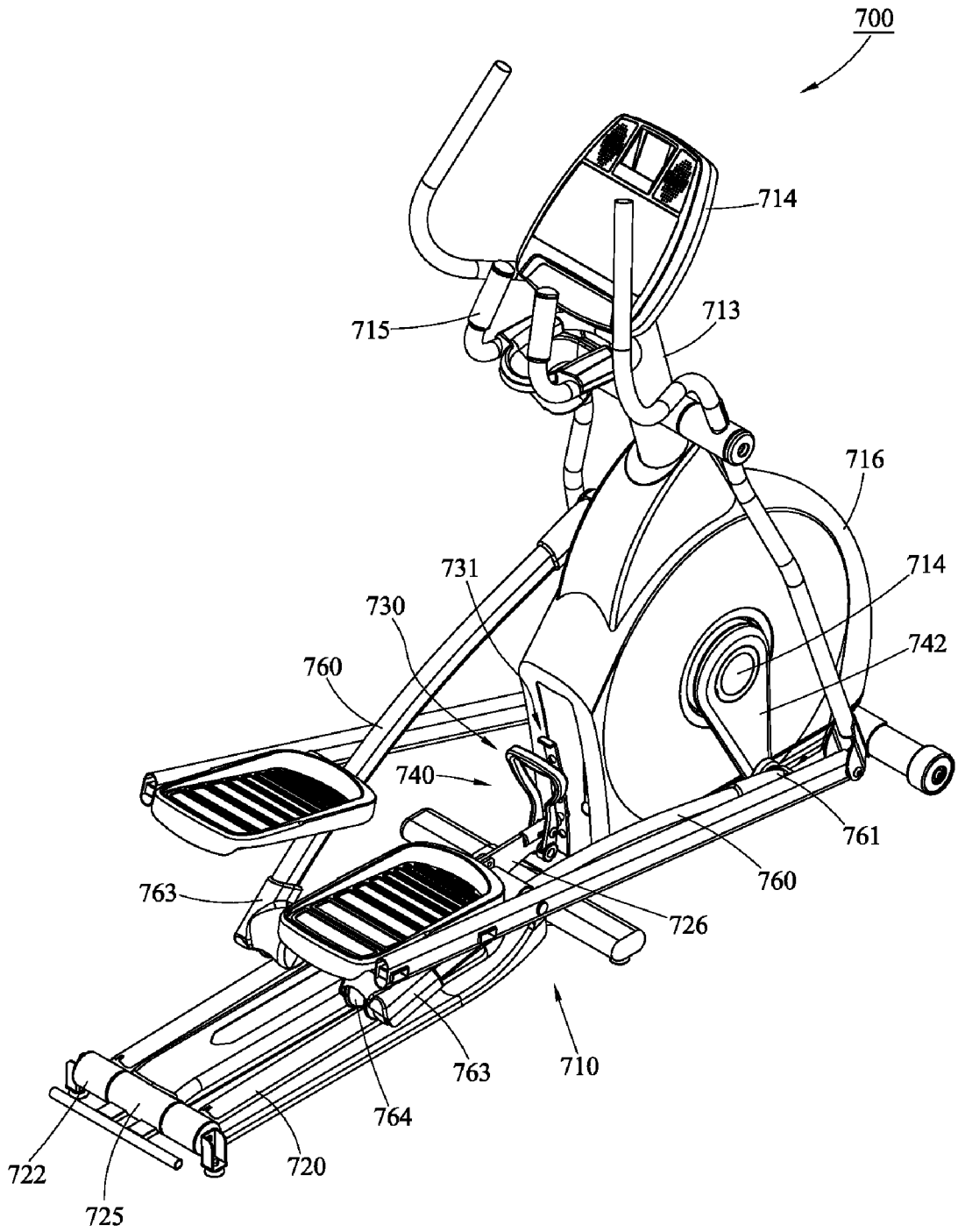
FIG. 26 is a perspective view of a sixth embodiment of a stationary exercise apparatus in accordance with the present invention.

FIG. 26 illustrates an embodiment having substantial portions similar to the embodiment depicted in FIG. 17. The embodiment of a stationary exercise apparatus 700 includes a frame 710 having a base 711 for supporting on a ground surface and a rear portion 725. The frame 710 also includes a front portion having a post covered under a shroud 716 and a standard 713. A fixed handle assembly 715 and a console 714 are also provided as described above in relation to the previous embodiments. In addition, the rear part of the shroud 716 has been removed from the drawing in order to show inner mechanisms.

The embodiment of the stationary exercise apparatus 700 includes rotating members 742 that rotate about a first axis 714, similar to those described and illustrated in relation to the above-mentioned embodiments. In the current embodiment, the rotating members 742 are a pair of cranks.

Similar to the embodiment illustrated in FIG. 17, the embodiment of the stationary exercise apparatus 700 also includes first and second supporting members 760. Each of the first and second supporting members 760 has a first portion 761 rotatably jointed to the corresponding rotating member 742. Also, each of the first and second supporting members 760 has a second portion 763 preferably coupled with a roller 764 or slider for engaging with a guider 720 to move reciprocally. The guider 720 is a track having surfaces thereon for being engaged by the second portions 763 of the first and second supporting members 760.

Figure 28:
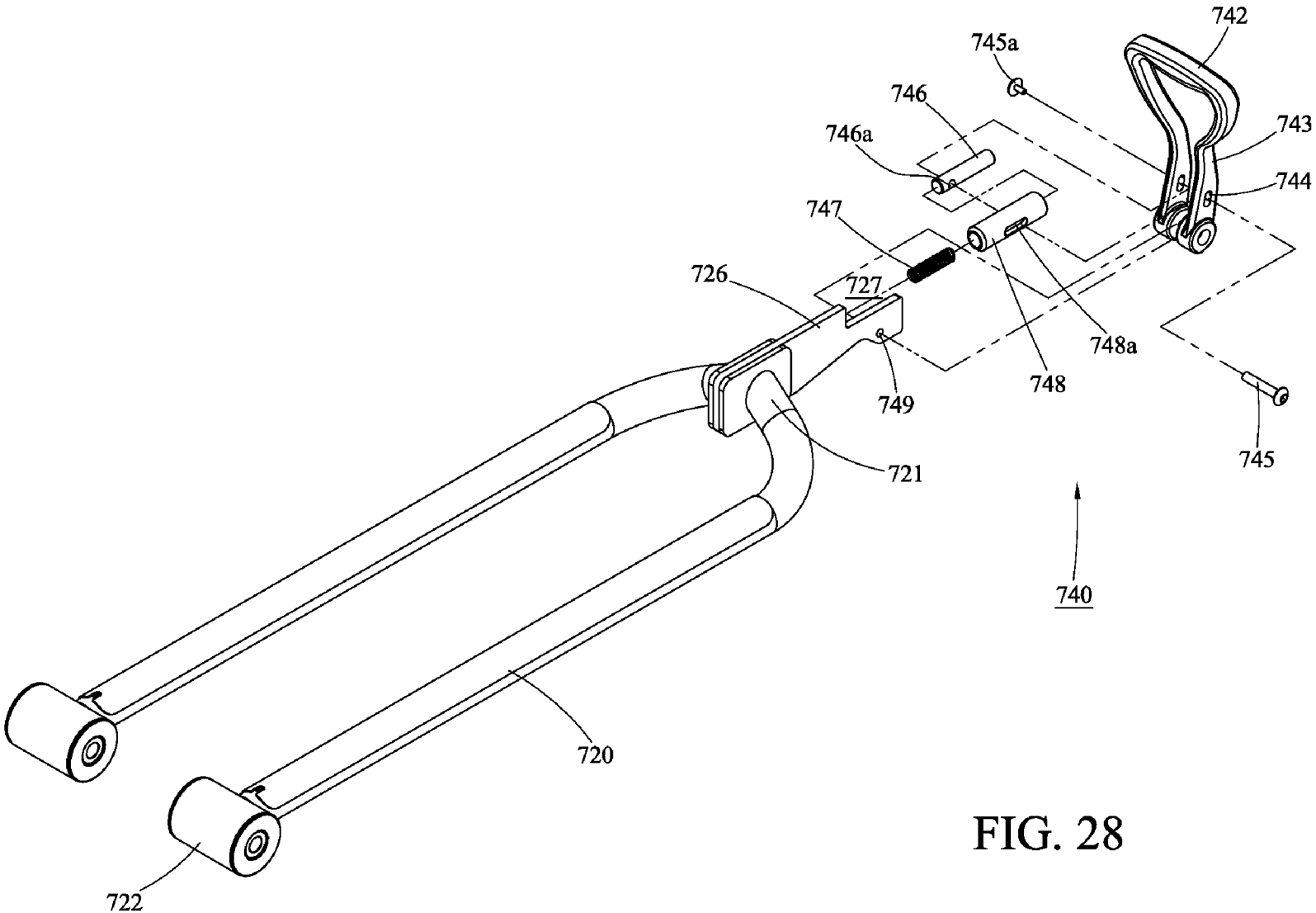
FIG. 28 is an exploded view of the elevating assembly and a guider of the stationary exercise apparatus of FIG. 26.

Referring to FIG. 26 and FIG. 28, the guider 720 has a first end portion 721 and a second end portion 722. The second end portion 722 is configured to be pivoted about the rear portion 725 of the base 711, so that the first end portion 721 of the guider 720 can be rotated in a vertical plane to change an elevation angle between the guider 720 and the ground surface. The guider 720 further includes an extending piece 726 extending from the first end portion 721 of the guider 720. As shown in FIG. 28, the extending piece 726 is a thin plate and has a notch 727 in the upper-front portion thereof.

Figure 27:
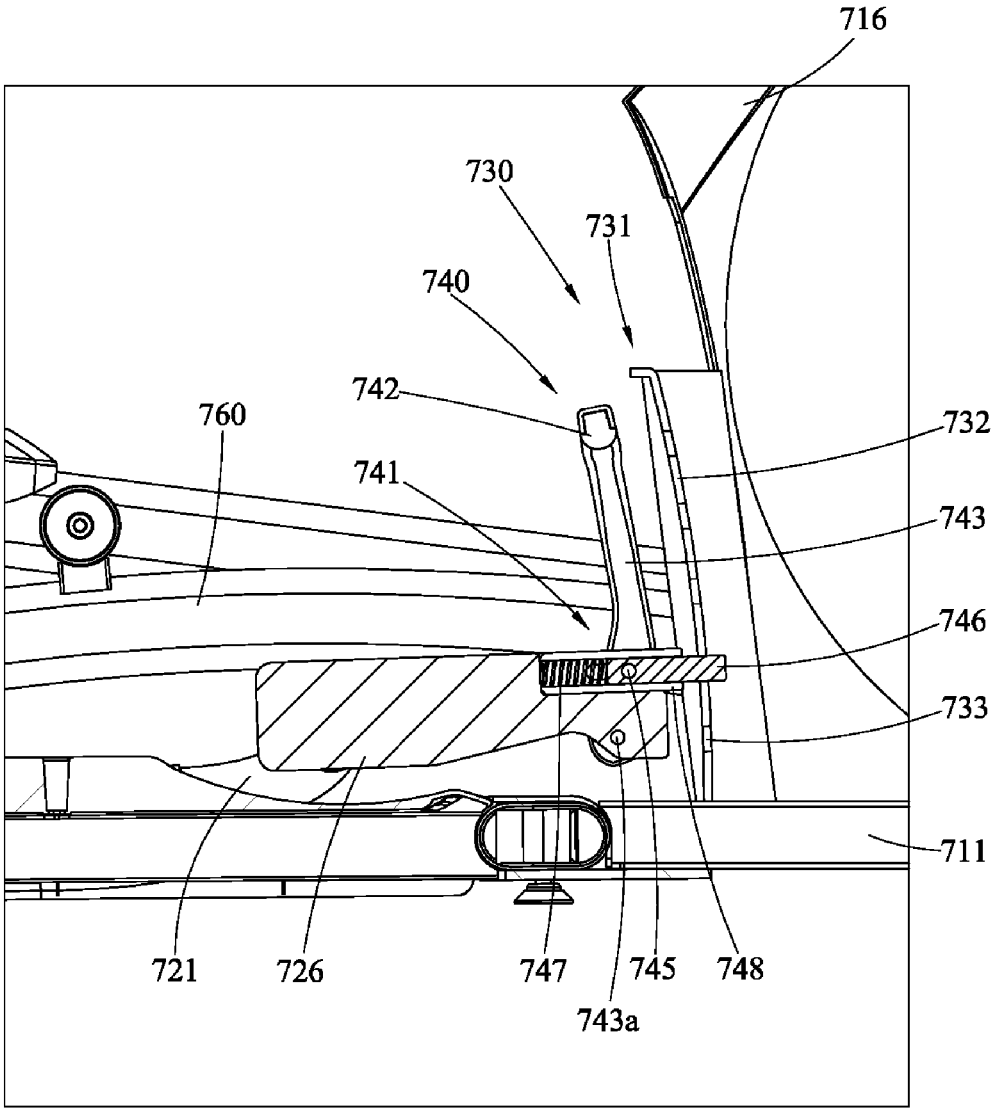
FIG. 27 is an enlarged view of an elevating assembly of the stationary exercise apparatus of FIG. 26 which is also part of a cross-sectional vertical view of the stationary exercise apparatus of FIG. 26.

Similar to the embodiment depicted in FIG. 17, the present embodiment also includes an elevating assembly 730 disposed in the lower-middle portion of the stationary exercise apparatus 700 as illustrated in FIG. 26. Referring to FIG. 27, the elevating assembly 730 includes a supporting bracket 731 mounted on the base 711 of the frame 710 and an actuating mechanism 740 coupled to the first end portion 721 of the guider 720. In the present embodiment, the supporting bracket 731 has an upright piece 732 extending upward from the base 711 of the frame 710 and a plurality of receiving portions 733 disposed thereon. The plurality of receiving portions 733 is a string of five holes in the current embodiment. The holes are arranged vertically in a predetermined distance and each of the holes is penetrated through the upright piece 732.

Referring to FIGS. 27 and 28, the actuating mechanism 740 substantially includes an actuating grip 742 and an engaging portion 741. In detail, the engaging portion 741 includes a positioning member 743, a resilient member 747, a sleeve 748, a positioning pin 746, and a cross pin 745. The positioning member 743 is composed of two legs, through which an oblong hole has been placed to form a slot 744 therein. The actuating grip 742 is connected to the upper portions of the legs of the positioning member 743. The positioning member 743 is configured to be pivoted toward the extending piece 726 about a hinge pin 743a to rotate about a lateral axis 749. Therefore, a user can grasp the actuating grip 742 to rotate the positioning member 743 forward or rearward through an arc path (not shown) relative to the guider 720. The notch 727 within the extending piece 726 is located between the legs of the positioning member 743, and the slots 744 within the positioning member 743 are substantially at the same height with the notch 727 within the extending piece 726. In other words, the through-hole formed by the slots 744 within the positioning member is substantially aligned with the notch 727 within the extending piece.

The front portion of the resilient member 747 is connected to the rear portion of the positioning pin 746. The rear portion of the resilient member 747 is connected to the vertical surface of the notch 727 within the extending piece 726. In the embodiment, the resilient member 747 is a spring and the spring biases the positioning pin 746 to move forward. Both the resilient member 747 and the major portion of the positioning pin 746 are located within the sleeve 748, and the sleeve 748 is disposed in the notch 727 within the extending piece 726. Furthermore, the positioning pin 746 has a hole 746*a* which passes through the rear portion thereof. The sleeve 748 also has two oblong holes 748*a* respectively disposed on the left and right sides thereof in a substantially fore-and-aft direction relative to the base 711. When the positioning member 743, the resilient member 747, the positioning pin 746, and the sleeve 748 are all set as above described, the slots 744 within the positioning member 743, the oblong holes 748*a* of the sleeve 748, and the hole 746*a* within the positioning pin 746 are lined up. Therefore the positioning member 743 and the positioning pin 746 are configured to be pinned together by a cross pin 745 that passes through the slots 744 within the positioning member 743, through the oblong holes 748*a* of the sleeve 748, and through the hole 746*a* within the positioning pin 746. A nut 745*a* may be fixed to the free end of the cross pin 745 to prevent the cross pin 745 from backing out.

As mentioned above, the resilient member 747 biases the positioning pin 746 to move forward in a linear direction guided by the sleeve 748. Therefore, the resilient member 747 also drives the cross pin 745 to move with the positioning pin 748 relative to the slot 744 within the positioning member 743, and relative to the oblong holes 748*a* within the sleeve 748. In the normal default position, the resilient member 747 pushes the positioning pin 748 as far forward as it can go, and the cross pin 745 is pushed forward until it has moved to the foremost position within the oblong holes 748*a* within the sleeve 748, where the cross pin, and therefore the positioning pin 748, is prevented from moving any further forward. In this foremost position, a portion of the positioning pin 746 outside the sleeve 748 is engaged with one of the receiving portions 733 of the supporting bracket 731 as shown in FIG. 27.

A user can select a desired incline level of the guider 720 by operating the elevating assembly 730. The first step of an operation process is to grasp the actuating grip 742 of the actuating mechanism 740 and then pull the actuating grip 742 backward. The actuating grip 742 is pivotally connected to the first end portion 721 of the guider 720, so that the positioning member 743 pivots about the axis 749, and the positioning member 743 is moved along an arc path as the user pulls the actuating grip 742 backward. The actuating grip 742 and the engaging portion 741 of the actuating mechanism 740 are both positioned on the same side of the axis 749, so that the engaging portion 741 of the actuating mechanism 740 also moves in the same direction as the actuating grip 742 to pull back on the cross pin 745, thereby retracting the positioning pin 748 to disengage the positioning pin 748 from one of the receiving portions 733 of the supporting bracket 731. Referring to FIG. 27, during the process of pulling back on the actuating grip 742, a force is exerted on the cross pin 745 to retract the positioning pin 747, thereby compressing and energizing the resilient member 747. The cross pin 745 is constrained by the oblong holes 748*a* within the sleeve 748, and the positioning pin 746 is constrained by the sleeve 748 to linearly retract back into the sleeve 748, thereby causing the front portion of the positioning pin 746 disengage from the supporting bracket 731. In order to facilitate the linear motion of the positioning pin 746, the slots 744 within the positioning member 743 are substantially vertically disposed. Therefore, the cross pin 745 is linearly and substantially horizontally moved back relative to the sleeve 748 and linearly and substantially vertically moved relative to the positioning member 743 during the operation process. The second step of the operation process is to lift or lower the guider 720 to a selected incline level, hold the actuating grip 742 at the selected incline level, and to cease pulling back on the actuating grip 742, thereby releasing the force on the cross pin 745 to allow the energized resilient member 747 to extend the positioning pin 746 into engagement with a corresponding receiving portion 733 of the supporting bracket 731.

Alternative elevating assembly may also be used within the scope of the present invention. For example, the resilient member 747 is not necessarily needed, as the actuating grip 742 can be pushed forward to extend the positioning pin 746 into engagement with a corresponding receiving portion 733 of the supporting bracket 731. The engaging portion 741 of the actuating mechanism 740 is also not necessarily composed of a movably positioning pin 746. For instance, the engaging portion may be changed to be a hook, and the receiving portions of the supporting bracket 731 may also be changed to a geometry that would allow a hook to latch onto the supporting bracket 731.

The previously described embodiments of the present invention have many advantages, including: (a) to provide a user of the stationary exercise apparatus with a benefit of high exercise intensity; (b) to provide a user of the stationary exercise apparatus with a benefit of an inclined foot path; (c) to provide a user of the stationary exercise apparatus with a benefit of an increased stride length; and (d) to provide a user of the stationary exercise apparatus with a benefit of better gluteus exercise; (e) to provide the stationary exercise apparatus with a more harmonious and succinct appearance. The present invention does not require that all the advantageous features and all the advantages need to be incorporated into every embodiment thereof. Although the present invention has been described in considerable detail with reference to certain preferred embodiment thereof, other embodiments are possible. Therefore, the spirit and scope of the appended claims should not be limited to the description of the preferred embodiment contained herein.

What is claimed is:

1. A stationary exercise apparatus, comprising:

a. a frame having a base, a front, and a rear portion;

b. first and second supporting members, each supporting member having a first end portion and a second end portion, the first end portions of the first and second supporting members respectively coupled to the frame to rotate about a first axis;

c. a guider having a first end portion and a second end portion, the second end portion of the guider coupled to the base, the second end portions of the first and second supporting members engaged with the guider for reciprocating movement relative to the guider;

d. first and second pedals respectively coupled to the first and second supporting members;

e. a supporting bracket mounted on the frame, the supporting bracket having a plurality of receiving portions positioned therein; and f. an actuating mechanism operably coupled to the first end portion of the guider, the actuating mechanism having an actuating grip and an engaging portion selective engaged with one of the receiving portions of the supporting bracket wherein the engaging portion is disengaged from the supporting bracket when the actuating grip thereof is moved relative to the guider.

2. The stationary exercise apparatus of claim 1, wherein the actuating grip is pivotally connected to the first end portion of the guider via an axis.

3. The stationary exercise apparatus of claim 2, wherein the actuating grip and the engaging portion of the actuating mechanism are on the same side relative to the axis.

4. The stationary exercise apparatus of claim 1, wherein the engaging portion of the actuating mechanism is composed of a positioning pin movably coupled therein.

5. The stationary exercise apparatus of claim 1, wherein the engaging portion of the actuating mechanism is composed of a positioning pin movably coupled therein, and wherein the positioning pin is moved in substantially the same direction with the actuating grip of the actuating mechanism when the actuating grip of the actuating mechanism is moved relative to the guider.

6. The stationary exercise apparatus of claim 1, the stationary exercise apparatus further comprising a resilient member interconnected between the engaging portion of the actuating mechanism and the first end portion of the guider for biasing the engaging portion of the actuating mechanism into engagement with one of the receiving portions of the supporting bracket as the engaging portion of the actuating mechanism is disengaged therefrom.

7. The stationary exercise apparatus of claim 1, the actuating mechanism further comprising a positioning member and a cross pin, the positioning member having a slot and the positioning member interconnected between the actuating grip and the engaging portion of the actuating mechanism, and the cross pin positioned within the slot of the positioning member to be movably coupled to the positioning member, the cross pin connected to the positioning pin, wherein the positioning member is pivotally connected to the first end portion of the guider via an axis, such that rotation of the positioning member about the axis moves the positioning member through an arc path, the positioning pin moves in a linear direction, and the cross pin moves with the positioning pin and relative to the slot.

8. A stationary exercise apparatus, comprising:

a. a frame having a base, a front, and a rear portion;

b. first and second supporting members, each supporting member having a first end portion and a second end portion, the first end portions of the first and second supporting members respectively coupled to the frame to rotate about a first axis;

c. a guider having a first end portion and a second end portion, the second end portion of the guider coupled to the base such that the first end portion of the guider is movable along an adjusting path, the second end portions of the first and second supporting members engaged with the guider for reciprocating movement relative to the guider;

d. first and second pedals respectively coupled to the first and second supporting members;

e. a supporting bracket mounted on the frame, the supporting bracket conforming to the adjusting path and a plurality of receiving portions positioned therein; and f. an actuating mechanism having a positioning member pivotally mounted on the first end portion of the guider via an axis, an actuating grip connected to the positioning member, and a positioning pin mounted on the positioning member and operably engaged with the receiving portion of the supporting bracket wherein the positioning pin can be disengaged from the receiving portion and moved along the adjusting path of the supporting bracket while the actuating grip is rotated about the axis.

9. The stationary exercise apparatus of claim 8 wherein the actuating grip and the positioning pin of the positioning member are at opposite sides relative to the axis.

10. The stationary exercise apparatus of claim 9, wherein the positioning pin is rotated in the same direction about the axis with the actuating grip of the positioning member when the actuating grip thereof is moved relative to the guider.

11. The stationary exercise apparatus of claim 9, further comprising a resilient member interconnected between the positioning pin and the first end portion of the guider for biasing the positioning pin into engagement with one of the receiving portions of the supporting bracket as the positioning pin is disengaged therefrom.

12. The stationary exercise apparatus of claim 9, the stationary exercise apparatus further comprising first and second control links respectively coupled to the first and second supporting members, each control link having a first end portion and a second end portion, the first end portions of the first and second control links movably coupled to the frame, the second end portions of the first and second control links respectively connected to the first and second pedals.

* * * * *